US009604225B2

(12) United States Patent
Muller-Siebert et al.

(10) Patent No.: US 9,604,225 B2
(45) Date of Patent: Mar. 28, 2017

(54) ELECTRODE ARRANGEMENT FOR AN ELECTRODYNAMIC FRAGMENTATION PLANT

(75) Inventors: Reinhard Muller-Siebert, Bern (CH); Fabrice Monti Di Sopra, Thun (CH); Bernhard Hasler, Langenthal (CH); Harald Giese, Stutensee (DE)

(73) Assignee: selFrag AG, Kerzers (CH)

( * ) Notice: Subject to any disclaimer, the term of this patent is extended or adjusted under 35 U.S.C. 154(b) by 365 days.

(21) Appl. No.: 14/007,535

(22) PCT Filed: Mar. 8, 2012

(86) PCT No.: PCT/CH2012/000054

§ 371 (c)(1),
(2), (4) Date: Oct. 28, 2013

(87) PCT Pub. No.: WO2012/129713

PCT Pub. Date: Oct. 4, 2012

(65) Prior Publication Data

US 2014/0042146 A1 Feb. 13, 2014

(30) Foreign Application Priority Data

Mar. 30, 2011 (CH) ..... 2011/000066

(51) Int. Cl.
*B02C 19/18* (2006.01)

(52) U.S. Cl.
CPC ..... *B02C 19/18* (2013.01); *B02C 2019/183* (2013.01)

(58) Field of Classification Search
CPC .... B02C 19/18; B02C 2019/183; H05H 1/48; H05H 1/26

(Continued)

(56) References Cited

U.S. PATENT DOCUMENTS 3,715,082 A * 2/1973 Carley-Macauly ..... B02C 19/18 241/1
2006/0163392 A1* 7/2006 Hoppe ..... B02C 19/18 241/1
2015/0069153 A1* 3/2015 Ahlqvist Jeanneret . B02C 19/18 241/1

FOREIGN PATENT DOCUMENTS

CN 201105234 Y 8/2008
DE 19534232 A1 3/1997

(Continued)

OTHER PUBLICATIONS

International Search Reporting in corresponding PCT/CH2012/000054 dated Jul. 24, 2012. (English Translation).

(Continued)

*Primary Examiner* — Mark Paschall
(74) *Attorney, Agent, or Firm* — Marshall, Gerstein & Borun LLP

(57) ABSTRACT

The invention relates to an electrode arrangement for an electrodynamic fragmentation plant having a passage opening (1) for fragmentation material (3) and having several electrode pairs (4*a*, 5*a*; 4*a*, 5*b*; 4*b*, 5*c*; 4*b*, 5*d*; 4*c*, 5*e*; 4*c*, 5*f*; 4*d*, 5*g*; 4*d*, 5*h*) by means of which, by charging the electrodes (4*a*-4*d*, 5*a*-5*h*) thereof with high-voltage pulses, in each case high-voltage discharges can be generated within the passage opening (1), for fragmentation of the fragmentation material (3). The passage opening (1) is formed in such a way and the electrodes (4*a*-4*d*, 5*a*-5*h*) of the electrode pairs are arranged therein in such a way that for each electrode pair (4*a*, 5*a*; 4*a*, 5*b*; 4*b*, 5*c*; 4*b*, 5*d*; 4*c*, 5*e*; 4*c*, 5*f*; 4*d*, 5*g*; 4*d*, 5*h*) in the area of a shortest connecting line (L) between the electrodes of the respective electrode pair, a ball (K) can pass through the passage opening (1), the diameter of which is bigger than the length of this respective shortest connecting line (L).

With such an electrode arrangement it is possible to carry out an electrodynamic fragmentation of fragmentation material (Continued)

in an economical manner with comparatively small high-voltage pulses. This also results in the possibility of expanding the realizable target value range of existing plants considerably in the direction of larger target values by retrofitting such plants with the electrode arrangement according to the invention.

32 Claims, 22 Drawing Sheets

(58) Field of Classification Search
USPC ..... 219/384, 121.36, 121.52; 241/1, 38
See application file for complete search history.

(56) References Cited

FOREIGN PATENT DOCUMENTS

| | | | |
|---|---|---|---|
| FR | 1341851 | A | 11/1963 |
| GB | 2342304 | A | 4/2000 |
| JP | 11-033430 | | 2/1999 |
| RU | 1719075 | | 3/1992 |
| RU | 2411083 | C2 | 2/2011 |
| SU | 555226 | A1 | 4/1977 |
| SU | 697188 | A1 | 11/1979 |
| SU | 845843 | A1 | 7/1981 |
| SU | 845844 | A1 | 7/1981 |
| SU | 852356 | A1 | 8/1981 |
| SU | 1441542 | A1 | 10/1993 |
| WO | WO-99/03588 | A1 | 1/1999 |

OTHER PUBLICATIONS

International Search Report for Application No. PCT/CH2011/000066 dated Feb. 6, 2012.

* cited by examiner

ELECTRODE ARRANGEMENT FOR AN ELECTRODYNAMIC FRAGMENTATION PLANT

TECHNICAL FIELD

The invention relates to an electrode arrangement for an electrodynamic fragmentation plant, to a fragmentation plant comprising such an electrode arrangement as well as to a method for fragmenting material pieces using such an electrode arrangement according to the preambles of the independent claims.

PRIOR ART

In the electrodynamic fragmentation, the fragmentation material, for example a bulk of concrete pieces, is arranged between two electrodes and by charging the electrodes with high-voltage pulses, which lead to high-voltage breakdowns through the fragmentation material, is fragmented.

In case the fragmentation material shall be fragmented to a specific target size, it is withdrawn from the fragmentation zone once it has reached the target size.

For doing so, the fragmentation zone is designed in such a way that it boundaries feature one or several openings having a size corresponding to the target size, through which the fragmentation material which has been fragmented down to target size can leave the fragmentation zone.

From DE 195 34 232 A1 an arrangement for the electrodynamic fragmentation of fragmentation material is known, in which the bottom of the process vessel is formed by a bottom electrode which is embodied as a dome-shaped sieve, which is on ground potential. Above this bottom electrode, with a distance thereto, a central stick-shaped high-voltage electrode is arranged. In operation, the process vessel is filled with fragmentation material and a process liquid in such a manner that the fragmentation material as a bulk lies on the bottom of the process vessel and the high-voltage electrode dips into the bulk of fragmentation material and into the process liquid. Thereafter, the high-voltage electrode is charged with high-voltage pulses so that between the bottom electrode and the high-voltage electrode high-voltage breakdowns through the fragmentation material occur, which fragment this material. In doing so, fragments of the fragmentation material which are smaller than the sieve openings of the bottom electrode fall through these sieve openings and thereby leave the fragmentation zone.

From GB 2 342 304 A, arrangements for an elctrodynamic fragmentation are known, in which the fragmentation zone is restricted by two walls which are designed as electrodes, at least one of which comprises sieve openings. Also here, in operation a bulk of fragmentation material is introduced into the fragmentation zone and thereafter the walls which are designed as electrodes are charged with high-voltage pulses in such a manner that between these walls high-voltage breakdowns through the fragmentation material occur, which fragment this material. Fragments of the fragmentation material which are smaller than the sieve openings in the wall electrodes leave the fragmentation zone through these sieve openings.

Also from JP 11033430, arrangements for an electrodynamic fragmentation of fragmentation material are known, in which one or several funnel-shaped fragmentation zones are formed by walls that are designed as electrodes. Thereby, at the bottom end of the respective fragmentation zone, a discharge opening is defined by the smallest distance between the walls of this fragmentation zone which are designed as electrodes. Also here, in operation a bulk of fragmentation material is introduced into the respective fragmentation zone and thereafter the walls which are designed as electrodes are charged with high-voltage pulses, so that between these walls high-voltage breakdowns through the fragmetation material occur, which fragment this material. Fragments of the fragmentation material which are smaller than the smallest distances between the walls of the fragmentation zone which are designed as electrodes leave the fragmentation zone through the discharge opening.

An important disadvantage of the construction principals disclosed in DE 195 34 232 A1 and GB 2 342 304 comprising bottom electrodes or wall electrodes, respectively, which are designed as a sieve, consists in that these electrodes are relative costly in manufacturing, which in the light of the fact that the electrodes in electrodynamic fragmentation processes are comsumables, leads to high costs of operation. Further, there is the disadvantage, that the size of the sieve openings increases during operation, which leads to a corresponding change in the target size of the readily fragmented material.

All of the before mentioned arrangements furthermore have the disadvantage that the distance between the electrodes are equal to or bigger than the sieve openings or discharge openings, respectively, which in case that a coarse fragmentation is desired leads to relative large electrode distances with the requirement of providing high-voltage pulses of corresponding magnitude. This in turn requires the use of very expensive high-voltage pulse generators.

DISCLOSURE OF THE INVENTION

Therefore there is the objective to provide an electrode arrangement and a fragmentation plant which do not have the disadvantages of the prior art or at least in part avoid them.

This objective is achieved by the electrode arrangement and the fragmentation plant according to the independent claims.

Accordingly, a first aspect of the invention concerns an electrode arrangement for an electrodynamic fragmentation plant having a passage opening or a passage channel, respectively, for fragmentation material and having one electrode pair or several electrode pairs, by means of which, by charging the electrodes of the respective electrode pair with high-voltage pulses, in each case high-voltage discharges can be generated within the passage opening or the passage channel, respectively, for fragmentation of the fragmentation material. A passage opening in the meaning of the claims can have a relative small axial extent in passing-through direction, while a passage channel in the meaning of the claims has a clearly more pronounced axial extent in passing-through direction and in particular is present in case electrodes are arranged, seen in passing-through direction, in several planes axially one behind the other.

The electrodes of the electrode pairs can be formed by separate single-electrodes and/or by electrode protrusions which are formed at one or several electrical conductive electrode bodies. In case of single-electrodes, these electrodes can be isolated against each other or can also be connected with each other in an electrical conductive manner. Also, it is possible that several electrode pairs share with each other a single-electrode or an electrode protrusion of an electrode body as common electrode. For example, it is possible that several electrode pairs are formed in that several single-electrodes which are on ground potential or several electrode protrusions of an electrode body which is on ground potential are dedicated to one single-electrode which is to be charged with high-voltage pulses or to one electrode protrusion of an electrode body which is to be charged with high-voltage pulses, so that a high-voltage breakdown per voltage pulse occurs via one of the so formed electrode pairs, depending on the actual situation with regard to conductivity in the area of the electrode pairs.

According to the invention, the passage opening or the passage channel, respectively, is designed in such a way and the electrodes of the electrode pairs are arranged therein in such a way or the passage opening or the passage channel is formed by the electrodes of the electrode pair or of the electrode pairs in such a way that in the area of a shortest connecting line between the electrodes of at least one of the electrode pair, preferably with abutment to one or to both electrodes of this electrode pair, a ball can pass through the passage opening or the passage channel, the diameter of which is bigger than the length of this shortest connecting line between the electrodes. A ball in the sense of the claims is arranged "in the area of the shortest connecting line" between two electrodes in case the sum of the shortest connecting lines of this ball to these electrodes is shorter than the shortest connecting line between the two electrodes.

Thus, in other words the first aspect of the invention concerns an electrode arrangement for an electrodynamic fragmentation plant having a passage opening or a passage channel, respectively, for fragmentation material and having at least two electrodes between which within the passage opening or the passage channel, by charging the same with high-voltage pulses, high-voltage discharges can be generated, for fragmentation of the fragmentation material. Thereby, the electrodes are arranged in such a way within the passage opening or the passage channel, respectively, or form the passage opening or the passage channel in such a way that the shortest connecting line between two electrodes, between which high-voltage discharges can be generated, is smaller than the diameter of the biggest ball which can pass through the passage opening or the passage channel, respectively, in the area of these two electrodes.

With such an electrode arrangement it is possible, at least in a partial area of the electrode arrangement, to carry out an electro dynamic fragmentation of fragmentation material in an economical manner with comparatively small high-voltage pulses. This also results in the possibility of expanding the realizable target value range of existing plants considerably in the direction of larger target values by retrofitting such plants with the electrode arrangement according to the invention.

In a preferred embodiment, the electrode arrangement comprises several electrode pairs by means of which, by charging the respective dedicated electrodes with high-voltage pulses, in each case high-voltage discharges can be generated within the passage opening or the passage channels, respectively, for fragmentation of the fragmentation material. By advantage, the passage opening or the passage channel, respectively, is formed in such a way and the electrodes of the electrode pairs are arranged therein in such a way or the passage opening or the passage channel, respectively, is formed by the electrodes of the electrode pairs in such a way that at each electrode pair in the area of the shortest connecting line between the electrodes thereof, preferably with abutment to one or to both electrodes of this electrode pair, a ball can pass through the passage opening or the passage channel, the diameter of which in each case is bigger than the length of the respective shortest connecting line between the electrodes. Thus, preferably in the area of each of the electrode pairs in each case a ball can pass through the passage opening or the passage channel, the diameter of which is bigger than the length of the shortest connecting line between the electrodes of the respective electrode pair.

With such an electrode arrangement it is possible to carry out an electrodynamic fragmentation of fragmentation material in an economical manner with comparatively small high-voltage pulses in the entire area of the passage opening or passage channel, respectively.

Preferably, the electrode arrangement is designed in such a way that, seen in passing-through direction of the passage opening or of the passage channel, respectively, on both sides of the respective shortest connecting lines between the electrodes of the respective electrode pair in the area of this shortest connecting line, preferably with abutment to one of the electrodes or to both of the electrodes, a ball can pass through the passage opening or the passage channel, respectively, the diameter of which is bigger than the length of this shortest connecting line. By this, electrode arrangements with especially good fragmentation performances become possible.

In a further preferred embodiment, the electrode arrangement is designed in such a way that the diameter of the respective ball, which in the area of the respective shortest connecting line between the electrodes of the respective electrode pair, preferably with abutment to at least one of the two electrodes of the respective electrode pair, can pass through the passage opening or the passage channel, respectively, in each case is bigger than 1.2 times, preferably bigger than 1.5 times the length of the respective shortest connecting line between the electrodes.

In still a further preferred embodiment of the electrode arrangement, the passage opening or the passage channel, respectively, has a round or square, preferably circular basic shape or cross-sectional shape, at which, one or several electrode protrusions which by advantage have the shape of a stick or tip, in particularly radially protrude from the outer boundaries of the passage opening or the passage channel into the passage opening or the passage channel, respectively, preferably in a way that they leave open the center of the passage opening or of the passage channel, respectively. Such electrode arrangement can be easily manufactured and furthermore make possible designs in which worn out electrode protrusions in an easy way can be replaced from the outside.

In another preferred embodiment of the electrode arrangement, the passage opening or the passage channel has a ring-shaped, preferably a circular ring-shaped basic shape or cross-sectional shape. A passage opening or a passage channel having a ring-shaped basic shape or cross-sectional shape is here in the broadest sense a passage opening or a passage channel which, seen in direction of flow, extends completely around a body which forms its inner boundaries. Thereby, the ring-shaped basic shape or cross-sectional shape, respectively, can have diverse geometrical shapes, e.g. star-shaped or polygonal, in particular can be rectangular or quadratic or can have the shape of an elliptic ring or of a circular ring. Furthermore, it can have, seen in flow direction, a uniform or a varying width over its circumference.

By means of this, the scope for design with regard to the passage opening or the passage channel is considerably broadened and embodiments become possible in which, via a central high-voltage supply, a plurality of electrode pairs which are intended for generating high-voltage discharges within the passage opening or the passage channel, can be charged with high-voltage pulses.

Thereby, it is preferred that from the inner boundaries of the passage opening or the passage channel and/or from the outer boundaries of the passage opening or the passage channel one or several electrode protrusions, which by advantage have the shape of a stick or tip, protrude into the passage opening or the passage channel, respectively. By means of this, it is possible to create, seen over the circumference of the passage opening or passage channel, respectively, a plurality of passing-through passages for fragmentation material that has been fragmented down to target size, which in each case are bordered by electrode pairs, which electrode pairs expose any pieces of fragmentation material, which adjoin to them and are bigger than the target size, to high-voltage discharges and thereby fragment them until they have reached target size and can pass through the passage opening or the passage channel via the respective passing-through passage.

Further it is preferred that the electrode protrusions perpendicularly to the intended passing-through direction or inclined in a direction opposite to the intended passing-through direction protrude into the passage opening or into the passage channel. In the first mentioned case, the advantage is arrived at that such electrode arrangements, even with interchangeable electrode protrusions, are relative simple to manufacture and can be provided at correspondingly low costs. In the latest mentioned case, the advantage is arrived at that the electrode protrusions are aligned towards the fragmentation material, which increases the likelihood of a direct contact with the fragmentation material, whereby, in particular at specific fragment sizes the fragmentation material, a further improvement in the efficiency of the fragmentation process is made possible.

Also it is in this embodiment preferred that the inner boundaries and/or the outer boundaries of the passage opening or of the passage channel, respectively, in each case are formed by an isolating body, which carries individual electrode protrusions. By means of this it becomes possible to replace worn-out electrode protrusions in a cost-efficient manner, without having to replace the entire boundaries of the passage opening or passage channel, respectively, for doing so. Thereby, the electrode protrusions can be isolated against each other or some or all of the electrode protrusions can be connected with each other in an electrically conducting manner, e.g. via a connecting line which is arranged inside the isolator body.

In a preferred variant of the two before described embodying variants of the preferred embodiment of the electrode arrangement having a ring-shaped passage opening or a ring-shaped passage channel, from the inner boundaries and from the outer boundaries of the passage opening or of the passage channel, respectively, in each case several electrode protrusions having the shape of a stick or tip protrude into the passage opening or the passage channel, respectively. Thereby, to each of the electrode protrusions which protrude from the inner boundaries into the passage opening or the passage channel, respectively, in each case there are dedicated at least two of the electrode protrusions which are protruding from the outer boundaries into the passage opening or the passage channel, respectively. By means of this, the respective electrode protrusion which is arranged at the inner boundaries forms together with the dedicated electrode protrusions at the outer boundaries several electrode pairs, which share same as a common electrode. Accordingly, a high-voltage discharge which emanates from the respective electrode protrusion which is arranged at the inner boundaries will, depending on the situation with regard to the conductivity in the area between this electrode protrusion and the dedicated electrode protrusions at the outer boundaries, take place to one of the dedicated electrode protrusions at the outer boundaries. By this design, with each electrode protrusion that is arranged at the inner boundaries several fragmentation zones can be formed inside the passage opening or the passage channel, respectively.

In a further preferred embodiment of the electrode arrangement, from the inner boundaries of the passage opening or of the passage channel one or several electrode protrusions, which preferably have the shape of a stick or tip, protrude into the passage opening or the passage channel, while the outer boundaries of the passage opening or of the passage channel are formed by one single electrode, which preferably has the shape of a ring. Thus, the outer boundaries of the passage opening or the passage channel form a framed electrode, which in each case with each of the electrode protrusions form an electrode pair. Such an electrode is sturdy and is cost-efficient in manufacturing.

In still a further preferred embodiment of the electrode arrangement, from the inner boundaries of the passage opening or passage channel several electrode protrusions, which preferably have the shape of a stick or tip, protrude into the passage opening or the passage channel, wherein a part or all of these electrode protrusions, inclined in a direction opposite to the intended passing-through direction, protrude into the passage opening or the passage channel, preferably in such a manner that their free ends in axial direction extend beyond a body which carries these electrode protrusions. By this, the likelihood of a direct contact of the electrode protrusions with the fragmentation material is further increased, which, as has already been mentioned, in particular in case of specific fragment sizes of the fragmentation material, makes possible a further improvement of the efficiency of the fragmentation process.

In an advantageous variant of the preferred embodiment of the electrode arrangement, in which the passage opening or the passage channel has a ring-shaped, preferably circular ring-shaped basic shape or cross-sectional shape, the inner boundaries of the passage opening or of the passage channel, respectively, are formed by one single, preferably disc-shaped, stick-shaped or ball-shaped electrode. Such a design is sturdy and can be manufactured in a cost-efficient manner.

In still a further preferred embodiment of the electrode arrangement, it comprises a passage channel for fragmentation material, inside which, at different axial positions with respect to the intended passing-through direction, from the outer boundaries and/or, if present, from the inner boundaries of the passage channel electrode protrusions, which preferably have the shape of a stick or tip, protrude into the passage channel. Such electrode arrangements in the following are termed as multistage electrode arrangements.

Thereby, it is of advantage that electrode protrusions, which are arranged at different axial positions, at different circumferential positions of the outer boundaries and/or of the inner boundaries protrude into the passage channel. With such electrode arrangements, within a small area an exceptionally intensive treatment of the fragmentation material with high-voltage discharges can be achieved.

Preferably, in such multistage electrode arrangements, a part or all of the electrode protrusion, which seen in passing-through direction are arranged at the first axial position, inclined in a direction opposite to the intended passing-through direction protrude into the passage channel.

In that case it is further preferred that at least a part or all of the electrode protrusion which protrude from the inner boundaries of the passage channel into the passage channel and are arranged at the first axial position, inclined in a direction opposite to the intended passing-through direction protrude into the passage channel. By means of this, as has already been mentioned, the advantage is arrived at that the likelihood of a direct contact of the electrode protrusions with the fragmentation material is further increased. This in turn has a positive effect on the efficiency of the fragmentation process.

Further, it is in such multistage electrode arrangements preferred that the electrode protrusion, which seen in passing-through direction are arranged at an axial position following the first axial position, thus the electrode protrusions which are arranged on a second, third and so on axial position, perpendicularly to the intended passing-through direction or inclined in the intended passing-through direction protrude into the passage channel. By this, the passing of the fragmentation material, which has been fragmented to target size, through the passage channel is facilitated.

In a further preferred embodiment of the multistage electrode arrangement, the electrode protrusions protrude into the passage channel in such a manner that it cannot be passed by a cylindrical body having hemispherical ends, which has a diameter corresponding to the diameter of the largest ball that can pass through the passage channel and has a height of more than 1.1 times, preferably of more than 1.3 times this diameter. By means of this, it becomes possible to make the passage channel impassable for long pieces of fragmentation material having a diameter of the target fragment size and to thereby effect that the fragmentation material which is discharged from the passage channel substantially consists of compact pieces and contains only few or no long fragments.

In a further preferred embodiment of the electrode arrangement having electrode protrusions which radially protrude from the outer and/or, if present, from the inner boundaries of the passage opening or the passage channel, respectively, into the passage opening or the passage channel, the electrode protrusions, seen in the intended passing-through direction, are evenly distributed at the circumference of the outer boundaries and/or of the inner boundaries of the passage opening or the passage channel, respectively. By this, a geometry of the passage opening or passage channel, respectively, results, which promotes a fragmentation of the fragmentation material into as much as possible uniform pieces.

In still a further preferred embodiment of the electrode arrangement, at the intended discharging side of the passage opening or of the passage channel there is arranged a blocking arrangement, which with respect to its geometry is designed in such a manner and with respect to the passage opening or to the passage channel is arranged in such a manner that a ball with the diameter of the largest ball that can pass through the passage opening or the passage channel, respectively, can be guided away from the passage opening or the passage channel, respectively, while a cylindrical body having hemispherical ends, which has a diameter corresponding to the diameter of the largest ball that can pass through the passage opening or the passage channel and has a height of more than 1.1 times, in particular of more than 1.3 times this diameter, by the blocking arrangement is prevented from leaving the passage opening or the passage channel, respectively. By this, it is as well possible to make the passage channel impassable for long pieces of fragmentation material having the diameter of the target fragment size and to hereby effect that the fragmentation material which is discharged from the passage channel substantially is compact and contains practically no long fragments.

Thereby, it is of advantage that the blocking arrangement is designed as a deflecting device for the discharged fragmentation material, which device with respect to its distance to the electrodes and to the deflecting angle is designed in such a way that a ball with the diameter of the largest ball that can pass through the passage opening or the passage channel, can be guided away by the deflecting device from the passage opening or from the passage channel, while a cylindrical body having hemispherical ends, which has a diameter corresponding to the diameter of the largest ball that can pass through the passage opening or the passage channel and has a height of more than 1.1 times, in particular of more than 1.3 times this diameter, by the deflecting device is prevented from leaving the passage opening or the passage channel. Preferably, such deflecting devices are formed by one or several inclined deflecting sheets. Such blocking arrangements are effective in function and cost-effective in manufacturing.

A second aspect of the invention concerns a fragmentation plant for electrodynamic fragmentation of fragmentation material with at least one electrode arrangement according to the first aspect of the invention and with a high-voltage pulse generator for charging the electrodes of the electrode arrangement with high-voltage pulses. The use of the electrode arrangement according to the invention in such plants is the intended use thereof.

In a preferred embodiment of the fragmentation plant, the electrode arrangement is aligned in such a manner that the passage opening or the passage channel, respectively, has a vertical passing-through direction. In this way it becomes possible to effect the charging of the electrode arrangement with the material that is to be fragmented and the guiding of the fragmented material pieces through the passage opening or the passage channel exclusively by means of gravity forces.

In a further preferred embodiment of the fragmentation plant, the electrode arrangement has a passage opening or a passage channel having a ring-shaped, by advantage annular ring-shaped basic or cross-sectional shape. Thereby, the high-voltage pulse generator is arranged underneath the passage opening or the passage channel and the electrodes formed at the inner boundaries of the passage opening or the passage channel are directly from underneath charged by the high-voltage pulse generator with high-voltage pulses.

Thereby, it is further preferred that the outer boundaries of the passage opening or passage channel or the electrodes arranged at these outer boundaries are on ground potential. By this, merely the feed line which leads to the electrodes formed at the inner boundaries of the passage opening or of the passage channel must be isolated, and very short fed lines become possible, which is preferred.

A third aspect of the invention concerns the use of the fragmentation plant according to the second aspect of the invention for fragmenting of poorly conductive material, preferably of silicium, concrete or slag. In such uses, the advantages of the invention become especially clearly apparent.

A fourth aspect of the invention concerns a method for fragmenting of material by means of high-voltage discharges to a fragment size smaller than or equal to a target size.

Therein, an electrode arrangement according to the first aspect of the invention is used, which comprises a passage opening or a passage channel for the fragmentation material, which is designed in such a manner that material fragments having a fragment size smaller than or equal to the target size can pass through the passage opening or the passage channel, while material pieces having a fragment size bigger than the target size cannot pass the passage opening or the passage channel and therefore are retained by the electrode arrangement.

The electrode arrangement at one side of its passage opening or passage channel is charged with material that is to be fragmented having a fragment size bigger than the target size, whereat any material pieces which are included in the charged fragmentation material which have a fragment size smaller than or equal to the target size can pass through the passage opening or the passage channel.

The electrodes of the electrode arrangement are charged with high-voltage pulses so that high-voltage discharges occur within the passage opening or the passage channel, by means of which the material pieces which extend into the passage opening or the passage channel or which abut against the electrodes, respectively, are fragmented.

The material pieces which have been fragmented in this way to a fragment size smaller than or equal to the target size are guided through the passage opening or the passage channel of the electrode arrangement and thus are removed from the fragmentation zone.

By the method according to the invention it is possible to perform an electrodynamic fragmentation of material (fragmentation material) in an economical manner even with clearly smaller electrode distances than the target size of the fragmented material, whereby the advantage is arrived at that also with cost-effective high-voltage generators a fragmentation to relative large target sizes becomes possible.

In a preferred embodiment of the method, the charging of the electrode arrangement with the material that is to be fragmented and the transportation of the material pieces that have been fragmented through the passage opening or through the passage channel is effected by means of gravitation. By this, the advantage is arrived at that no auxiliary equipment for the transportation of the fragmentation material to the fragmentation zone and after the fragmenting away from it is needed.

In still a further preferred embodiment of the method, the passage opening or the passage channel of the electrode arrangement during the generating of high-voltage discharges is flooded with a process liquid. In a preferred variant, for doing so the passage opening or the passage channel in the passing-through direction of the material is flushed by a stream of process liquid. By the last mentioned measure, the removal of fine fragmentation material particles from the fragmentation zone, which particles have a negative effect on the fragmentation performance, is promoted.

BRIEF DESCRIPTION OF THE DRAWINGS

Further embodiments, advantages and applications of the invention become apparent from the dependent claims and from the following description on the basis of the drawings. Therein show:

MODES FOR CARRYING OUT THE INVENTION

Figure 1:
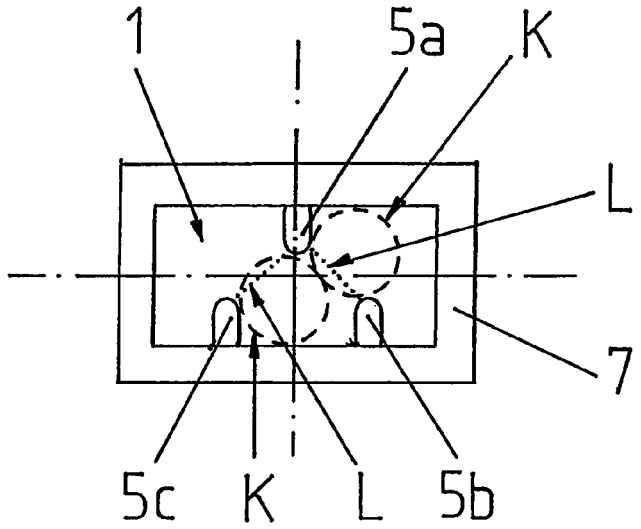
FIG. 1 a topview onto a first electrode arrangement according to the invention.

FIG. 1 shows a first electrode arrangement according to the invention for an electrodynamic fragmentation plant in a topview. As can be seen, the electrode arrangement comprises a passage opening 1 having a rectangular basic shape or cross-sectional shape, respectively, for fragmentation material, from the outer boundaries of which three stick-shaped electrode protrusions 5*a*, 5*b*, 5*c* protrude into the passage opening, thereby leaving open the center of the passage opening 1.

The outer boundaries of the passage opening 1 are formed by an isolator body 7. The electrode protrusions 5*a*, 5*b*, 5*c* are formed by single-electrodes, which are carried by the isolator body 7.

The two electrodes 5*b*, 5*c* which are commonly arranged at one side of the outer boundaries of the passage opening 1 are via a line (not visible) in an electrically conductive manner connected with each other and via the isolator body 7 are electrically isolated with respect to the electrode 5*a*, which is arranged opposite to them. In this way, the three electrodes 5*a*, 5*b*, 5*c* form two electrode pairs 5*a*, 5*b* and 5*a*, 5*c*, by means of which, by charging the electrodes with high-voltage pulses, e.g. in that the two lower electrodes 5*b*, 5*c* are put on ground potential while the upper electrode 5*a* is connected to a high-voltage pulse generator, in each case high-voltage discharges can be generated within the passage opening 1, for fragmentation of the fragmentation material which enters into the passage opening 1 or is located in the vicinity of one of the electrode pairs.

The passage opening 1 is designed in such a way and the electrodes 5*a*, 5*b*, 5*c* are arranged therein in such a way that for each electrode pair 5*a*, 5*b* and 5*a*, 5*c* in the area of the shortest connecting line L between the electrodes 5*a*, 5*b* and 5*a*, 5*c*, respectively, of the respective electrode pair (in each case depicted in dashed lines), a ball K (in each case depicted in dashed lines) can pass through the passage opening 1, the diameter of which is bigger than the length of this respective shortest connecting line L.

Figure 2:
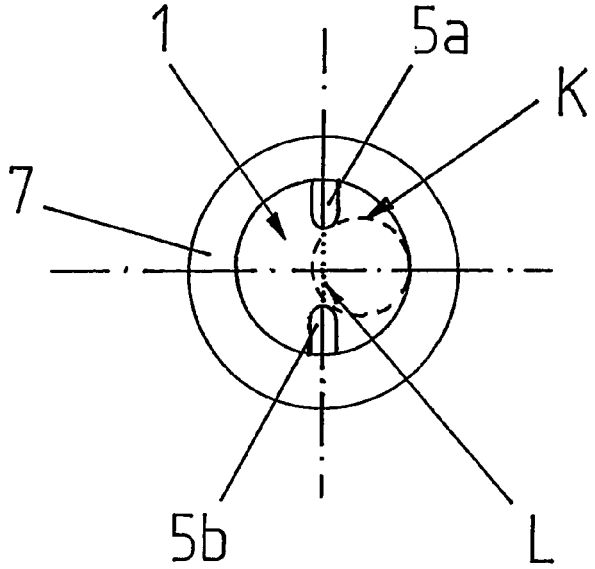
FIG. 2 a topview onto a second electrode arrangement according to the invention.

FIG. 2 shows a topview onto a second electrode arrangement according to the invention, which differs from the electrode arrangement shown in FIG. 1 in that its passage opening 1 has a circular basic shape or cross-sectional shape, respectively, from the outer boundaries of which on opposite sides two stick-shaped electrode protrusions 5*a*, 5*b* protrude into it, which as well are leaving open the center of the passage opening 1.

Also here, the outer boundaries of the passage opening 1 are formed by an isolator body 7 and the electrode protrusions 5*a*, 5*b* are formed by single-electrodes, which are carried by the isolator body 7.

Accordingly, the two electrodes 5*a*, 5*b* form an electrode pair 5*a*, 5*b*, by means of which high-voltage discharges can be generated within the passage opening 1.

Thereby, the passage opening 1 also here is designed in such a way and the electrodes 5*a*, 5*b* are arranged therein in such a way that in the area of the shortest connecting line L between the electrodes 5*a*, 5*b* (depicted in dashed lines), a ball K (depicted in dashed lines) can pass through the passage opening, the diameter of which is bigger than the length of this shortest connecting line L.

Figure 3:
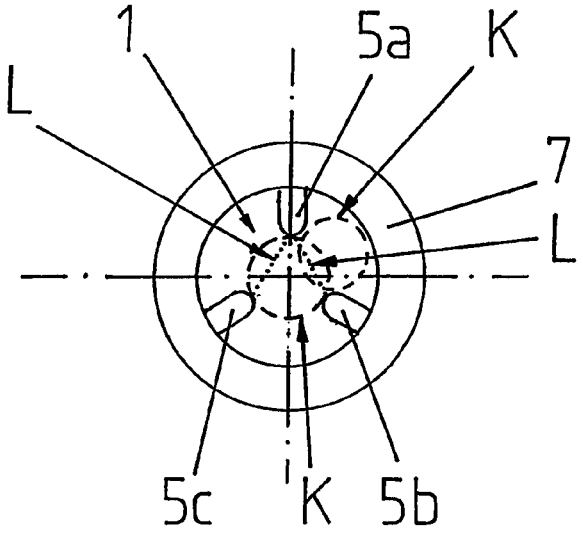
FIG. 3 a topview onto a third electrode arrangement according to the invention.

FIG. 3 shows a third electrode arrangement according to the invention in a topview, which differs from the electrode arrangement shown in FIG. 1 merely in that its passage opening 1 has a circular basic shape or cross-sectional shape, respectively, from the outer boundaries of which the electrode protrusions 5*a*, 5*b*, 5*c* radially protrude into it. All other statements made with regard to the electrode arrangement shown in FIG. 1 analogously apply also to this electrode arrangement and therefore must not be repeated here.

Figure 4:
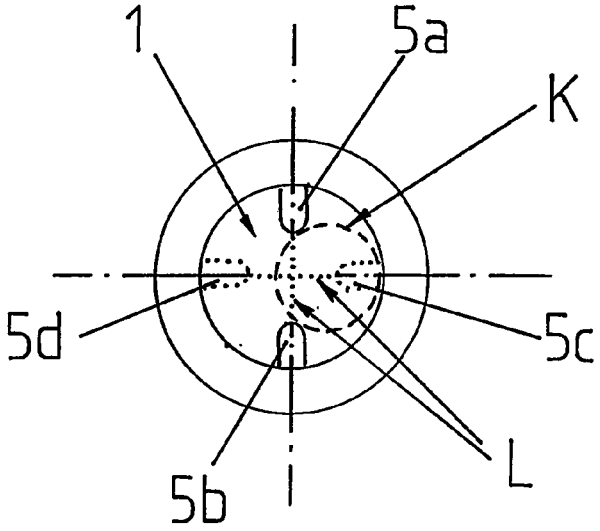
FIG. 4 a topview onto a fourth electrode arrangement according to the invention.

FIG. 4 shows a fourth electrode arrangement according to the invention in a topview, which differs from the electrode arrangement shown in FIG. 2 merely in that it consists of two electrode arrangements according to FIG. 2, which are arranged one behind the other and which comprise a common isolator body 7, and in that the rear electrode arrangement is rotated with respect to the front electrode arrangement by 90°. The electrodes 5*c*, 5*d* of the rear electrode arrangement are depicted here in dashed lines in order to indicate that these are arranged in a plane behind the electrodes 5*a*, 5*b* of the front electrode arrangement. All other statements made before with regard to the electrode arrangement shown in FIG. 2 analogously apply also to this electrode arrangement and therefore must not be repeated here.

Figure 5:
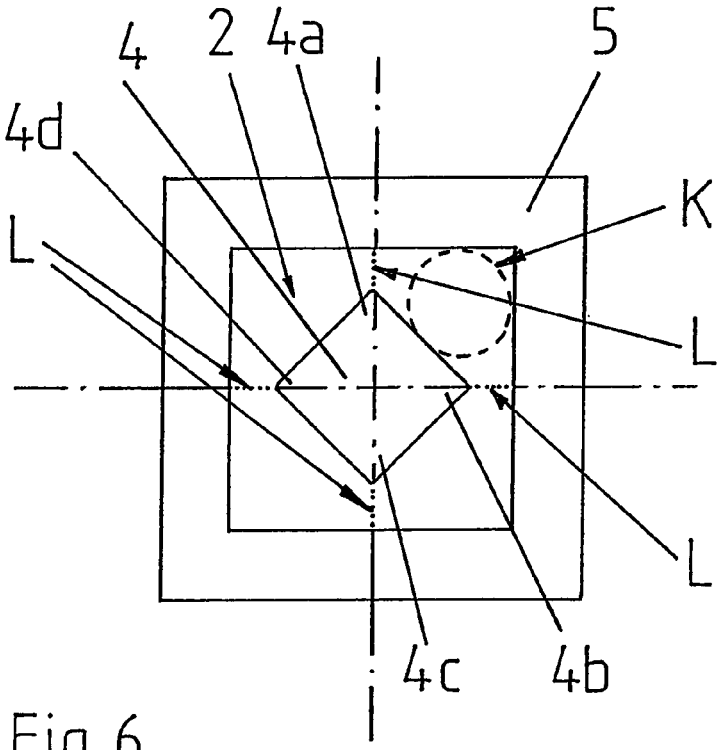
FIG. 5 a topview onto a fifth electrode arrangement according to the invention.

FIG. 5 shows a fifth electrode arrangement according to the invention in a topview. In this embodiment, the electrode arrangement has a passage channel 2 with a ring-shaped basic shape or cross-sectional shape, respectively, the outer boundaries of which are formed by a rectangular metal pipe 5, e.g. made of stainless steel. The inner boundaries of the passage channel 2 are formed by a solid metal profile 4, for example as well made of stainless steel, with a quadratic cross-section, which is arranged in the center of the pipe 5 and the outer surfaces of which form with the opposite inner surfaces of the rectangular metal pipe 5 in each case an angle of 45°. In the present case, the corners of the solid profile 4 serve as electrode protrusions 4*a*, 4*b*, 4*c*, 4*d*, which together with the respective opposite area of the inner wall of the metal pipe 5 in each case form an electrode pair 4*a*, 5; 4*b*, 5; 4*c*, 5; 4*d*, 5, by means of which, by charging the rectangular metal pipe 5 and the solid metal profile 4 with high-voltage pulses, e.g. in that the pipe 5 is put on ground potential while the solid profile 4 is connected to a high-voltage pulse generator, in each case high-voltage discharges can be generated within the passage channel 2. The shortest connecting lines L between the electrodes of the respective electrode pairs 4*a*, 5; 4*b*, 5; 4*c*, 5; 4*d*, 5 are depicted in dashed lines.

Thereby, as can be seen, the passage channel 2 is formed by the electrodes 4*a*, 4*b*, 4*c*, 4*d*, 5 in such a way that for each electrode pair 4*a*, 5; 4*b*, 5; 4*c*, 5; 4*d*, 5 in the area of the shortest connecting line L between the electrodes of the respective electrode pair, a ball K can pass through the passage channel 2, the diameter of which in each case is bigger than the length of this shortest connecting line L.

Figure 6:
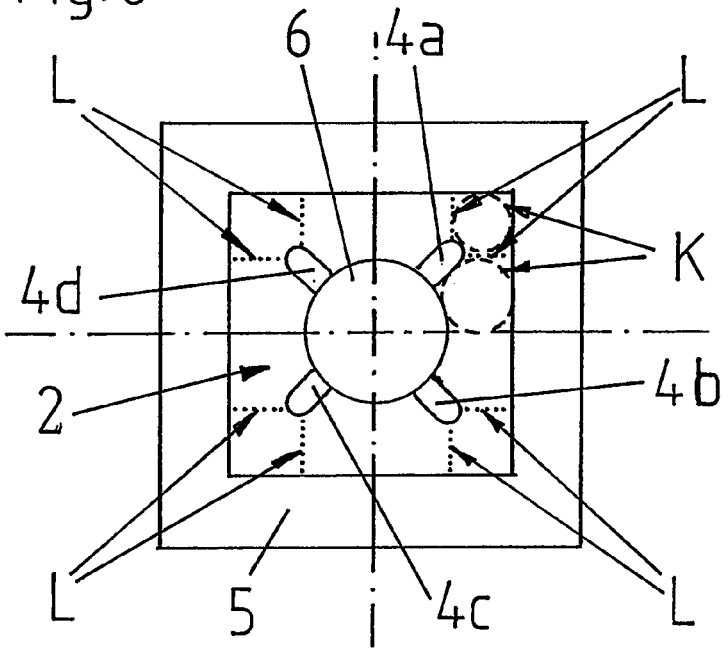
FIG. 6 a topview onto a sixth electrode arrangement according to the invention.

FIG. 6 shows a sixth electrode arrangement according to the invention in a topview, which differs from the electrode arrangement shown in FIG. 5 in that, in the center of the rectangular metal pipe 5, there is not arranged a solid metal profile 4 having a quadratic cross-section but an isolator body 6 having a circular cross-section, from which in each case, pointing in direction of one of the corners of the rectangular metal pipe 5, four electrode protrusions 4*a*, 4*b*, 4*c*, 4*d* which are formed by single-electrodes protrude radially outward. These electrodes 4*a*, 4*b*, 4*c*, 4*d* are screwed into an electric conductor (not shown) in the center of the isolator body 6 and by doing so are in an electrically conductive manner connected with each other, so that they can commonly be charged via these conductor with high-voltage pulses.

In the present case, each of the electrode protrusions 4*a*, 4*b*, 4*c*, 4*d* forms, together with each of the two inner walls of the rectangular metal pipe 5 which are arranged opposite to them, in each case an electrode pair, by means of which high-voltage discharges can be generated within the passage channel 2. The shortest connecting lines L between the electrodes of the respective electrode pairs formed in that way are in each case depicted in dashed lines.

Thereby, also here the passage channel 2 is designed in such a way and the electrodes 4*a*, 4*b*, 4*c*, 4*d*, 5 are arranged in such a way that at each of the eight electrode pairs which are formed by the electrodes 4*a*, 4*b*, 4*c*, 4*d* and the respective two inner walls of the rectangular stainless steel pipe 5 which are arranged opposite to each electrode 4*a*, 4*b*, 4*c*, 4*d*, in the area of the shortest connecting line L between the electrodes of the respective electrode pair, a ball K can pass through the passage channel 2, the diameter of which in each case is bigger than the length of this shortest connecting line L between the electrodes of the respective electrode pair.

Figure 7:
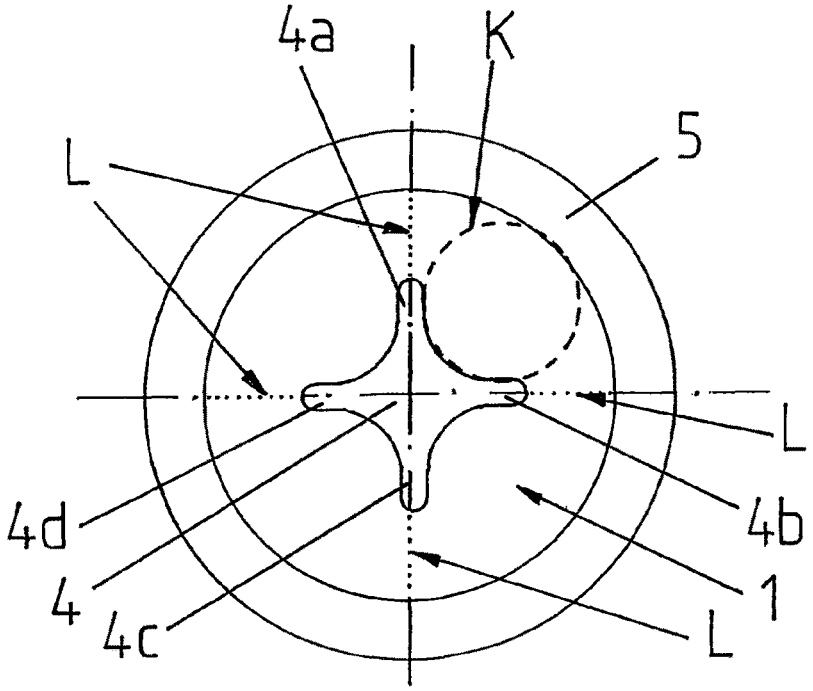
FIG. 7 a topview onto a seventh electrode arrangement according to the invention.

FIG. 7 shows a seventh electrode arrangement according to the invention in a topview. In this embodiment, the electrode arrangement has a passage opening 1 with a ring-shaped basic shape or cross-sectional shape, respectively, the outer boundaries of which are formed by a metal ring 5. The inner boundaries of the passage opening 1 are formed by a star-shaped electrode body 4, as well made of metal, which is arranged in the center of the ring 5. The star-shaped electrode body 4 forms four electrode protrusions 4*a*, 4*b*, 4*c*, 4*d*, which in each case form, together with the respective opposite inner wall area of the ring 5 which surrounds the electrode body 4, an electrode pair 4*a*, 5; 4*b*, 5; 4*c*, 5; 4*d*, 5, by means of which in each case high-voltage discharges can be generated within the passage channel 2. The shortest connecting lines L between the electrodes of the respective electrode pairs 4*a*, 5; 4*b*, 5; 4*c*, 5; 4*d*, 5 are depicted in dashed lines.

As can be seen, the passage opening 1 here is formed by the metal ring 5 and the electrode body 4 and the electrodes 4*a*, 4*b*, 4*c*, 4*d*, 5, respectively, in such a way that for each electrode pair 4*a*, 5; 4*b*, 5; 4*c*, 5; 4*d*, 5 in the area of the shortest connecting line L between the electrodes of the respective electrode pair, a ball K can pass through the passage opening 1, the diameter of which in each case is bigger than the length of the shortest connecting line L between the electrodes of the respective electrode pair 4*a*, 5; 4*b*, 5; 4*c*, 5; 4*d*, 5.

Figure 8:
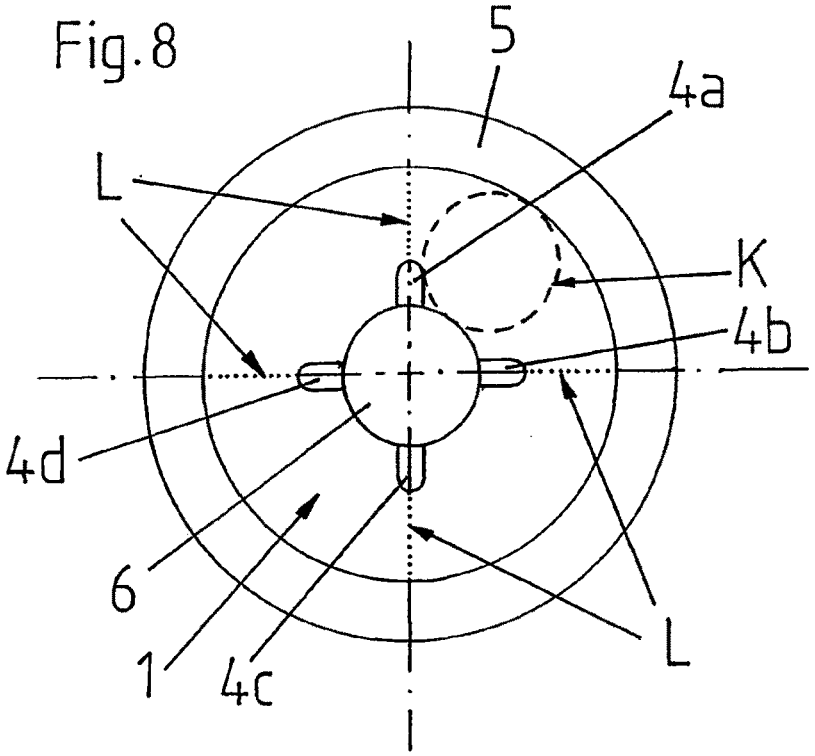
FIG. 8 a topview onto a eighth electrode arrangement according to the invention.

FIG. 8 shows an eighth electrode arrangement according to the invention in a topview, which differs from the electrode arrangement shown in FIG. 7 merely in that, instead of the star-shaped electrode body, an isolator body 6 with electrode protrusions 4*a*, 4*b*, 4*c*, 4*d* arranged at it as described with respect to the embodiment of FIG. 6 is arranged in the center of the metal ring 5.

Thereby, each of the electrode protrusions 4*a*, 4*b*, 4*c*, 4*d* forms, together with the respective opposite inner wall area of the ring 5 which surrounds the electrode body 4, an electrode pair 4*a*, 5; 4*b*, 5; 4*c*, 5; 4*d*, 5, by means of which high-voltage discharges can be generated within the passage channel 2. The shortest connecting lines L between the electrodes of the respective electrode pairs 4*a*, 5; 4*b*, 5; 4*c*, 5; 4*d*, 5 again are depicted in dashed lines.

In this way, also here the passage opening 1 is formed by the metal ring 5 and the isolator body 6 as well as by the electrodes 4*a*, 4*b*, 4*c*, 4*d* arranged at it in such a way that for each electrode pair 4*a*, 5; 4*b*, 5; 4*c*, 5; 4*d*, 5 in the area of the shortest connecting line L between the electrodes of the respective electrode pair, a ball K can pass through the passage opening 1, the diameter of which in each case is bigger than the length of the shortest connecting line L between the electrodes of the respective electrode pair 4*a*, 5; 4*b*, 5; 4*c*, 5; 4*d*, 5.

Figure 8A:
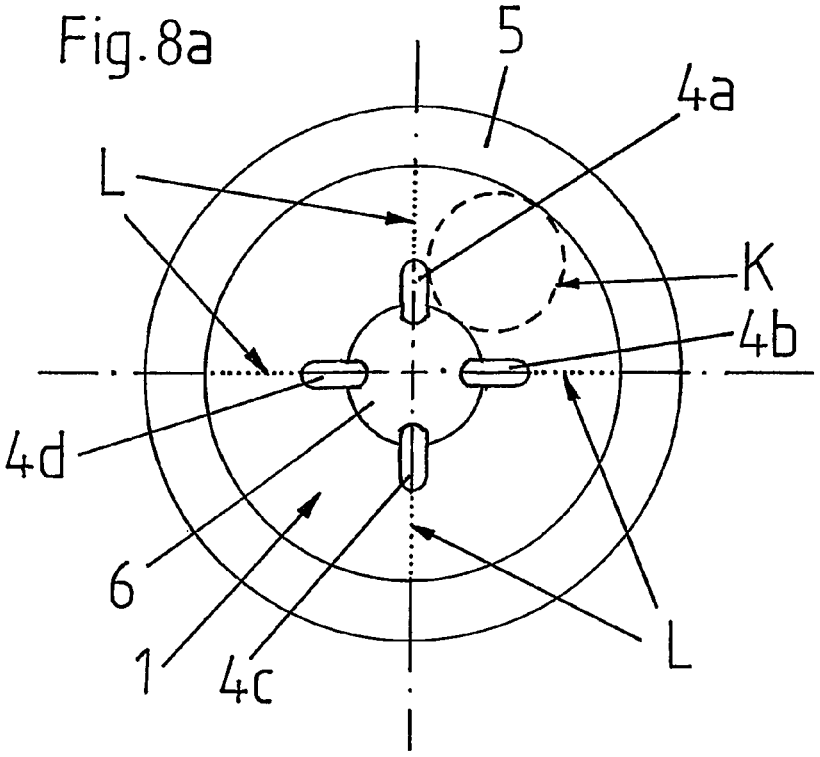
FIG. 8*a* a topview onto a ninth electrode arrangement according to the invention.

FIG. 8*a* shows an ninth electrode arrangement according to the invention in a topview, which differs from the electrode arrangement shown in FIG. 8 merely in that the electrode protrusions 4*a*, 4*b*, 4*c*, 4*d*, inclined in a direction that is opposite to the intended passing-through direction S protrude from the central isolator body 6 into the passage opening 1.

Figure 8B:
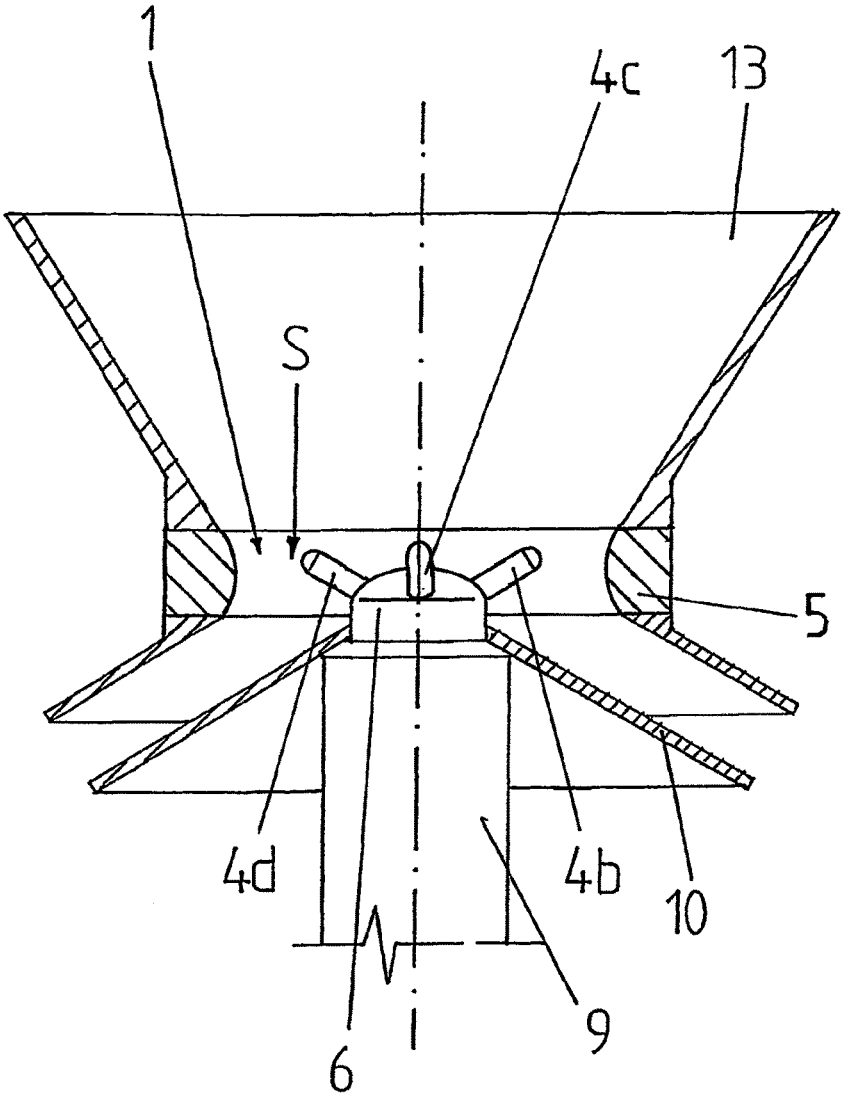
FIG. 8*b* a vertical section through a part of a first fragmentation plant according to the invention comprising the electrode arrangement of FIG. 8*a;*

As can be taken from FIG. 8*b*, which shows a vertical section through a part of a first fragmentation plant according to the invention comprising the electrode arrangement of FIG. 8*a*, the electrode arrangement inside the fragmentation plant is oriented such that its passage opening has a vertical intended passing-through direction S. The four electrode protrusions 4*a*, 4*b*, 4*c*, 4*d* form thereby the upper end of a high-voltage electrode 9, which is connected to a high-voltage pulse generator (not depicted) arranged directly underneath it, for charging the electrode protrusions 4*a*, 4*b*, 4*c*, 4*d* with high-voltage pulses. The metal ring 5 is on ground potential.

Above the electrode arrangement, i.e. on the entry side of the electrode arrangement, a feeding funnel 13 is arranged, by means of which the fragmentation material that is to be fragmented by gravity forces can be fed to the electrode arrangement.

Underneath the electrode arrangement, i.e. on the discharging side of the electrode arrangement, a deflecting device in the form of a cone-shaped deflecting sheet is arranged, which can radially towards the outside deflect the fragmentation material which is discharged from the electrode arrangement and has been fragmented to target size and by gravity forces remove it from the electrode arrangement.

Figure 9:
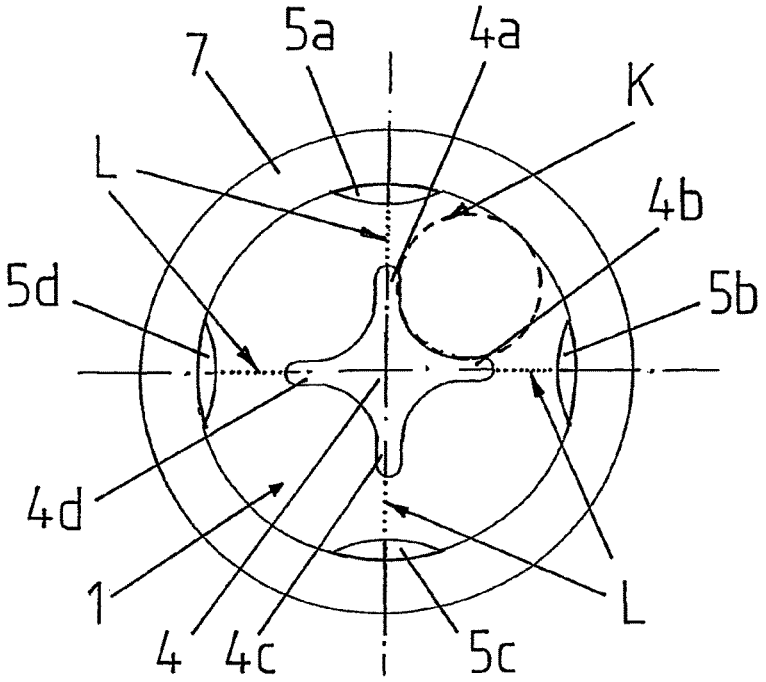
FIG. 9 a topview onto a tenth electrode arrangement according to the invention.

FIG. 9 shows a tenth electrode arrangement according to the invention in a topview, which differs from the electrode arrangement shown in FIG. 7 merely in that the outer boundaries of the passage opening 1 are not formed by a metal ring but are by a pipe-shaped isolator body 7, which on its inner side in each case opposite to the individual electrode protrusions 4*a*, 4*b*, 4*c*, 4*d* of the star-shaped electrode body 4 carries lens-shaped single-electrodes 5*a*, 5*b*, 5*c*, 5*d* made of metal, which via a connecting line (not shown) in an electrically conductive manner are connected with each other.

The four electrode protrusions 4*a*, 4*b*, 4*c*, 4*d* of the star-shaped electrode body 4 form in each case together with the respective single-electrodes 5*a*, 5*b*, 5*c*, 5*d* which are arranged opposite to them an electrode pair 4*a*, 5*a*; 4*b*, 5*b*; 4*c*, 5*c*; 4*d*, 5*d*, by means of which in each case high-voltage discharges within the passage channel 2 can be generated. The shortest connecting lines L between the electrodes of the respective electrode pairs 4*a*, 5; 4*b*, 5; 4*c*, 5; 4*d*, 5 again are depicted in dashed lines.

Also here, the passage opening 1 is formed by the pipe-shaped isolator body 7 with the single-electrodes 5*a*, 5*b*, 5*c*, 5*d* arranged thereon and the electrode body 4 in such a way that for each electrode pair 4*a*, 5*a*; 4*b*, 5*b*; 4*c*, 5*c*; 4*d*, 5*d* in the area of the shortest connecting line L between the electrodes of the respective electrode pair, a ball K can pass through the passage opening 1, the diameter of which is bigger than the length of the shortest connecting line L between the electrodes of the respective electrode pair 4*a*, 5*a*; 4*b*, 5*b*; 4*c*, 5*c*; 4*d*, 5*d*.

Figure 10:
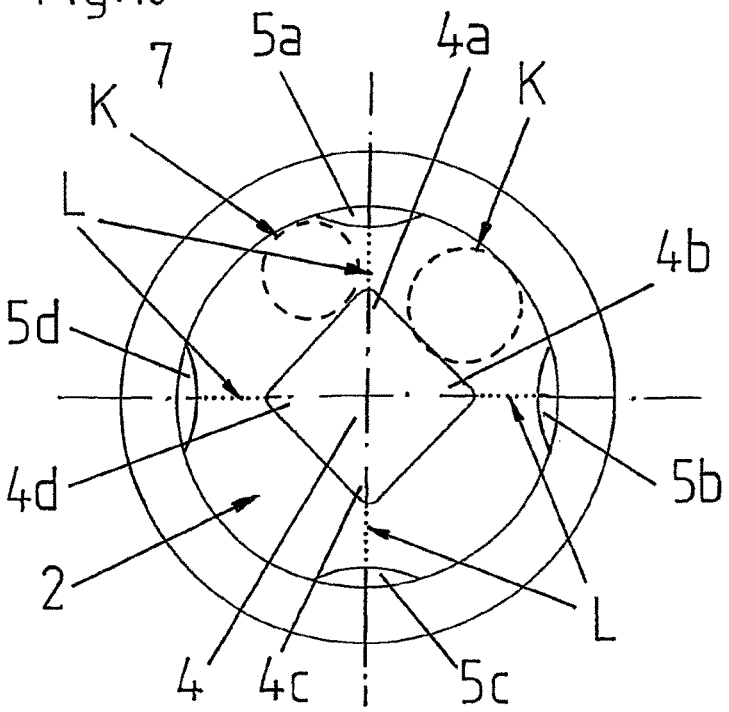
FIG. 10 a topview onto an eleventh electrode arrangement according to the invention.

FIG. 10 shows an eleventh electrode arrangement according to the invention in a topview, which differs from the electrode arrangement shown in FIG. 9 merely in that instead of the star-shaped electrode body, a solid metal profile 4 having a quadratic cross-section as in FIG. 5 is arranged in the center of the pipe-shaped isolator body 7.

Also here, the corners of the solid profile 4 serve as electrode protrusions 4*a*, 4*b*, 4*c*, 4*d*, which together with the respective lens-shaped single-electrode 5*a*, 5*b*, 5*c*, 5*d* which is arranged opposite to them, in each case form am electrode pair 4*a*, 5*a*; 4*b*, 5*b*; 4*c*, 5*c*; 4*d*, 5*d*, by means of which high-voltage discharges can be generated. The shortest connecting lines L between the electrodes of the respective electrode pairs 4*a*, 5; 4*b*, 5; 4*c*, 5; 4*d*, 5 again are depicted in dashed lines.

This electrode arrangement has a passage channel 2 which is formed by the pipe-shaped isolator body 7 with the single-electrodes 5*a*, 5*b*, 5*c*, 5*d* arranged thereon and the electrode body 4 in such a way that for each electrode pair 4*a*, 5*a*; 4*b*, 5*b*; 4*c*, 5*c*; 4*d*, 5*d* in the area of the shortest connecting line L between the electrodes of the respective electrode pair, a ball K can pass through the passage channel, the diameter of which is bigger than the length of the shortest connecting line L between the electrodes of the respective electrode pair 4*a*, 5*a*; 4*b*, 5*b*; 4*c*, 5*c*; 4*d*, 5*d*.

Figure 11:
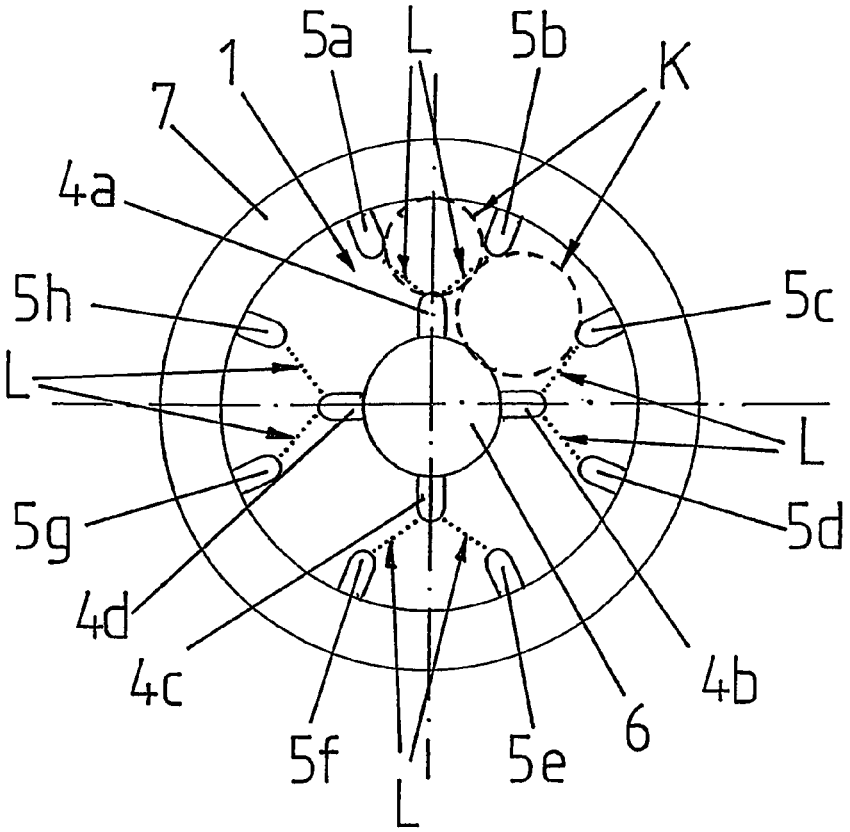
FIG. 11 a topview onto a twelfth electrode arrangement according to the invention.
Figure 11A:
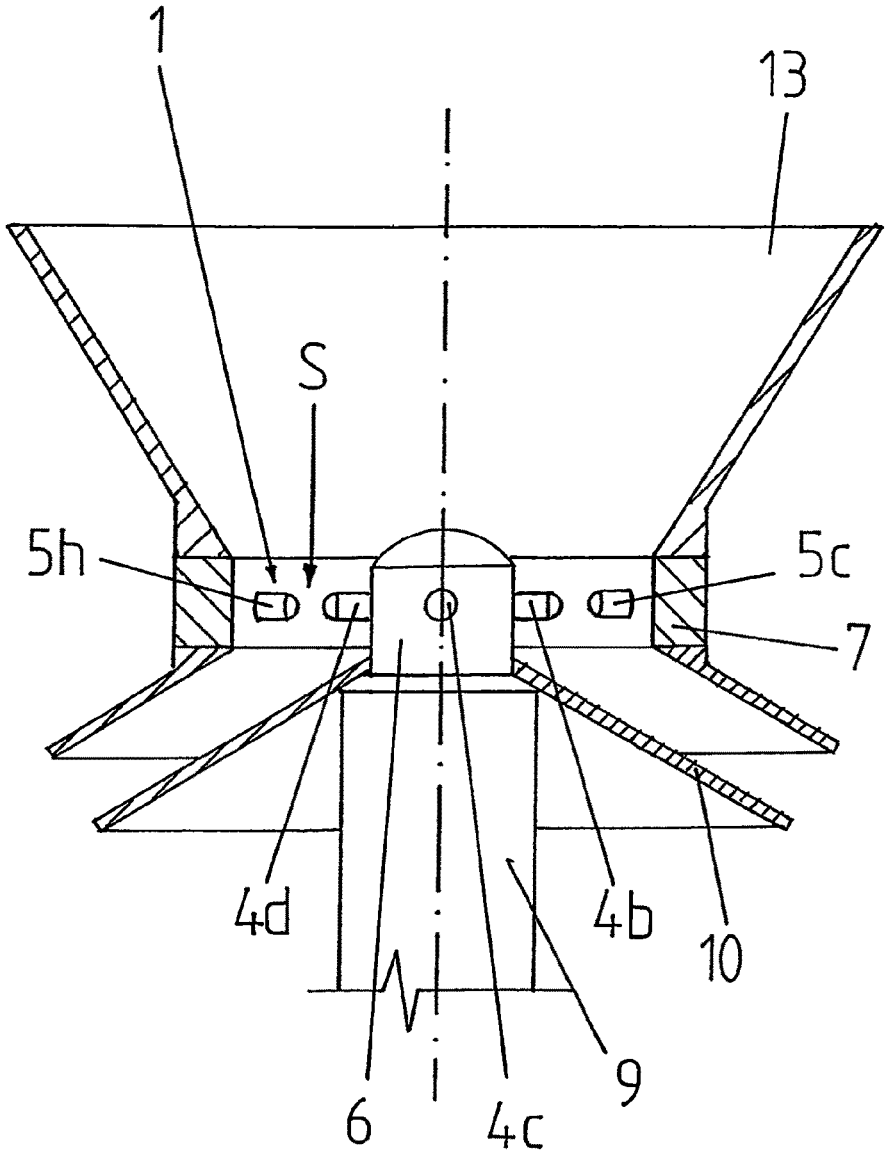
FIG. 11*a* a vertical section through a part of a second fragmentation plant according to the invention comprising the electrode arrangement of FIG. 11.
Figure 11B:
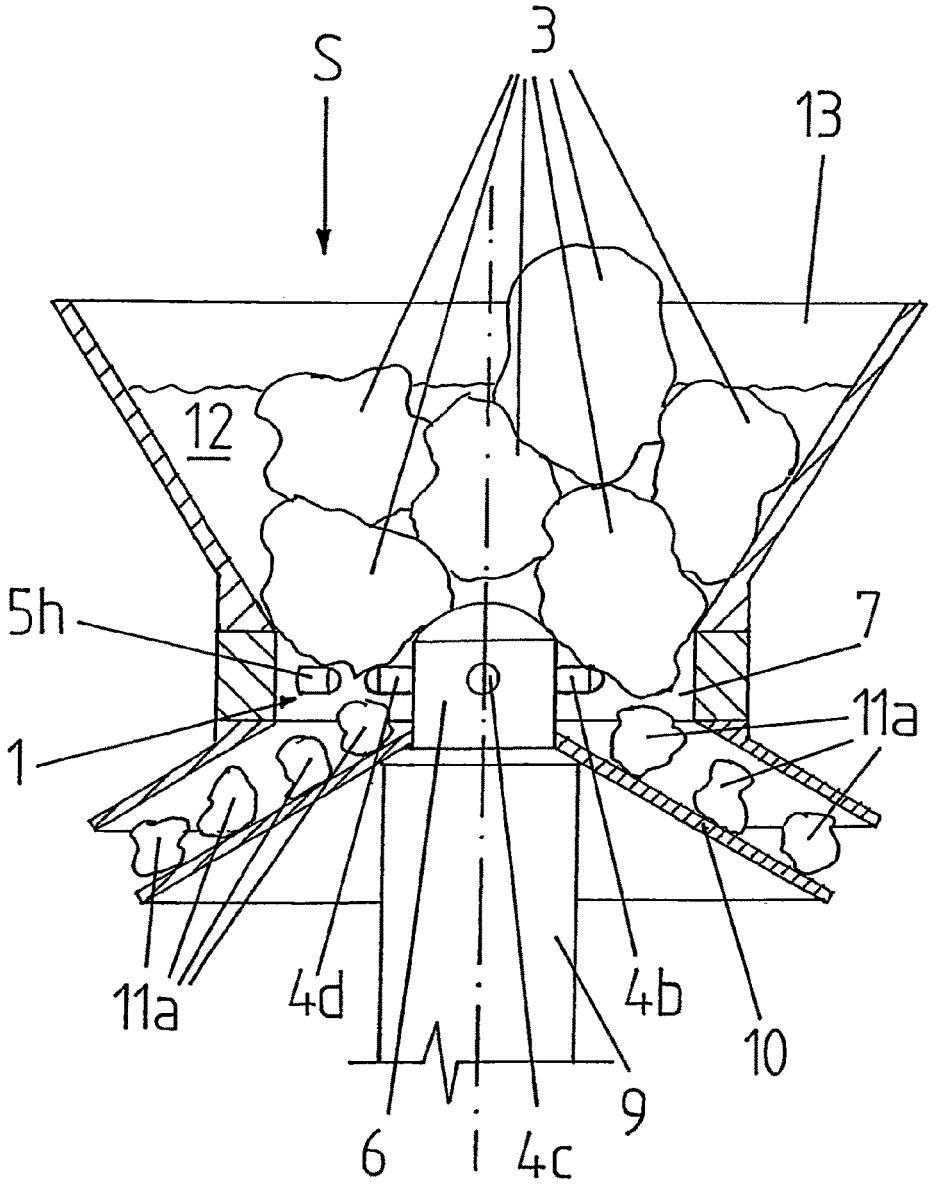
FIG. 11*b* a representation as FIG. 11*a* showing the plant according to the invention in the fragmenting operation.
Figure 11C:
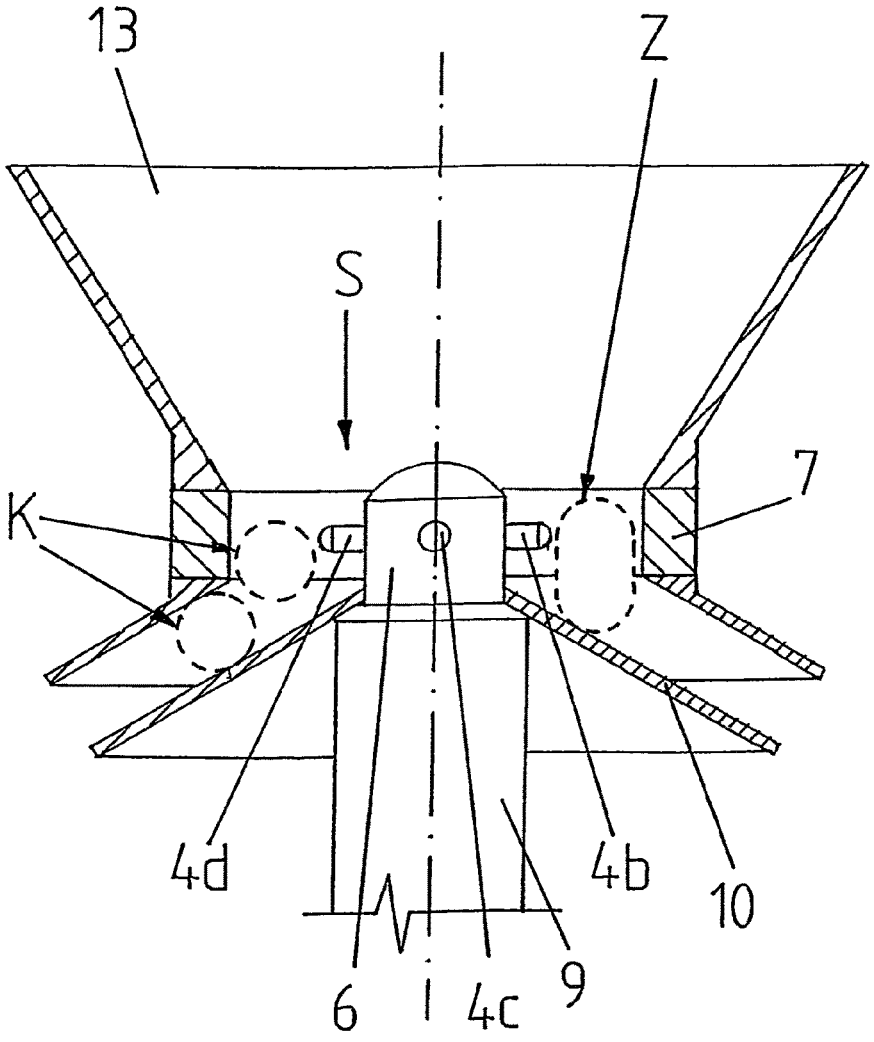
FIG. 11*c* a representation as FIG. 11*a* with schematically depicted ball-shaped and cylinder-shaped bodies arranged within the passage opening.

FIG. 11 shows a twelfth electrode arrangement according to the invention in a topview, which differs from the electrode arrangement shown in FIG. 8 in that the outer boundaries of the passage opening 1 instead of by a metal ring are formed by a pipe-shaped isolator body 7, which at its inner side features, uniformly distributed over its circumference, stick-shaped electrode protrusions 5*a*, 5*b*, 5*c*, 5*d*, 5*e*, 5*f*, 5*g*, 5*h* which radially protrude into the passage opening 1.

Thereby, to each of the electrode protrusions 4*a*, 4*b*, 4*c*, 4*d*, which from the central isolator body 6 in radial direction protrude into the passage opening 1, in each case there are dedicated two stick-shaped electrode protrusions 5*a*, 5*b*, 5*c*, 5*d*, 5*e*, 5*f*, 5*g*, 5*h*, which are arranged at the inner side of the pipe-shaped isolator body 7. In this way, in total eight electrode pairs 4*a*, 5*a*; 4*a*, 5*b*; 4*b*, 5*c*; 4*b*, 5*d*; 4*c*, 5*e*; 4*c*, 5*f*; 4*d*, 5*g*; 4*d*, 5*h* are formed with the electrode prodtrusions 4*a*, 4*b*, 4*c*, 4*d*, 5*a*, 5*b*, 5*c*, 5*d*, 5*e*, 5*f*, 5*g*, 5*h* which protrude from the inner and outer boundaries of the passage opening 1 into same, by means of which in each case high-voltage discharges within the passage opening 1 can be generated. The shortest connecting lines L between the electrodes of the respective electrode pairs again are depicted in dashed lines.

As can be seen, the passage opening 1 here is formed by the pipe-shaped isolator body 7 with the electrode protrusions 5*a*, 5*b*, 5*c*, 5*d*, 5*e*, 5*f*, 5*g*, 5*h* arranged thereon and the central isolator body 6 with the electrode protrusions 4*a*, 4*b*, 4*c*, 4*d* arranged thereon in such a way that for each electrode pair 4*a*, 5*a*; 4*a*, 5*b*; 4*b*, 5*c*; 4*b*, 5*d*; 4*c*, 5*e*; 4*c*, 5*f*; 4*d*, 5*g*; 4*d*, 5*h* in the area of the shortest connecting line L between the electrodes of the respective electrode pair, a ball K can pass through the passage opening 1, the diameter of which is bigger than the length of this shortest connecting line L between the electrodes of the respective electrode pair 4*a*, 5*a*; 4*a*, 5*b*; 4*b*, 5*c*; 4*b*, 5*d*; 4*c*, 5*e*; 4*c*, 5*f*; 4*d*, 5*g*; 4*d*, 5*h*.

Figure 11D:
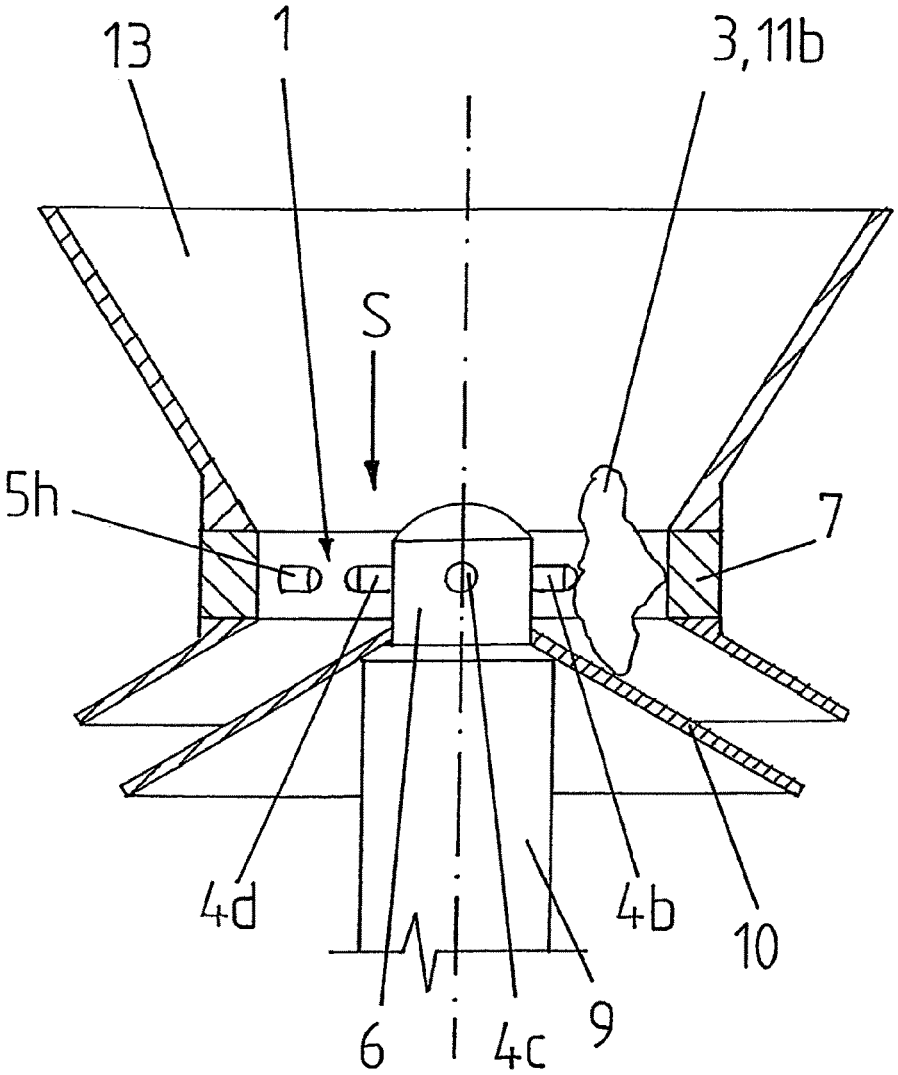
FIG. 11*d* a representation as FIG. 11*a* with a long fragment arranged within the electrode arrangement.

The FIGS. 11*a*, 11*b*, 11*c* and 11*d* show vertical sections through a part of a second fragmentation plant according to the invention comprising the electrode arrangement of FIG. 11, once without fragmentation material (FIG. 11*a*), once with fragmentation material (FIG. 11*b*), once with schematically depicted ball-shaped and cylinder-shaped bodies arranged in the passage opening (FIG. 11*c*) and once with a long fragment arranged within the passage opening 1 of the electrode arrangement (FIG. 11*d*).

As can be taken from these figures, the electrode arrangement is oriented within the fragmentation plant in such a manner that its passage opening 1 has a vertical passing-through direction S. Therein, the central isolator body 6 with the four electrode protrusions 4*a*, 4*b*, 4*c*, 4*d* forms the upper end of a cylindrical high-voltage electrode 9, which is connected to a high-voltage pulse generator (not depicted) directly positioned underneath it, for charging the electrode protrusions 4*a*, 4*b*, 4*c*, 4*d* with high-voltage pulses. The electrode protrusions 5*a*, 5*b*, 5*c*, 5*d*, 5*e*, 5*f*, 5*g*, 5*h* which are carried by the pipe-shaped isolator body 7 are put on ground potential.

Above the electrode arrangement, i.e. on the entry side of the electrode arrangement, a feeding funnel 13 is arranged, by means of which the fragmentation material 3 which is to be fragmented by gravity forces is fed to the electrode arrangement.

Underneath the electrode arrangement, i.e. on the discharging side of the electrode arrangement, a deflecting device in the form of a cone-shaped deflecting sheet 10 is arranged, which radially towards the outside deflects the fragmentation material which is discharged from the electrode arrangement and has been fragmented to target size and by gravity forces removes it from the electrode arrangement. As is visible in particular in FIG. 11*c*, the deflecting device 10 in this case forms a blocking arrangement which with respect to its geometry is designed in such a manner and with respect to the passage opening 1 is arranged in such a manner that a cylindrical body Z having hemispherical ends, which body has a diameter corresponding to the diameter of the largest ball K that can pass through the passage opening 1 in the respective passing-through area and has a height of more than 1.3 times this diameter, by this blocking arrangement 10 is prevented from leaving the passage opening 1, while the largest ball K that can pass through the passage opening 1 in the respective passing-through area can be guided away from the passage opening 1.

By this, the advantage depicted in FIG. 11*d* is arrived at that long pieces of fragmentation material 11*b* are retained in the passage opening 1 by the deflecting device 10 which acts as blocking arrangement and are further fragmented until they are short enough for passing the deflecting device 10 and for being guided away from the passage opening 1. By this, it can be achieved that the fragmentation material which is discharged substantially consists of compact pieces 11*a* and practically contains no long fragments 11*b*.

Figure 11E:
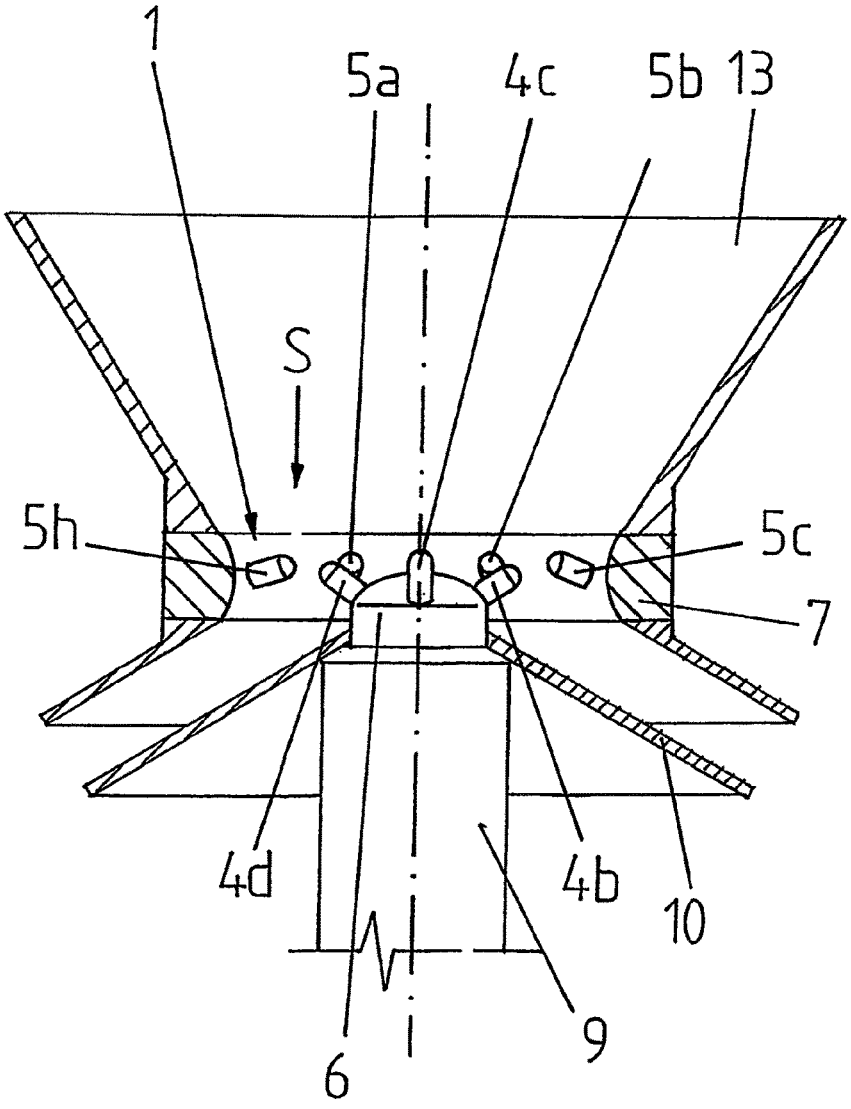
FIG. 11*e* a representation as FIG. 11*a* of the second fragmentation plant according to the invention with a variant of the electrode arrangement of FIG. 11.

FIG. 11*e* shows a variant of the second fragmentation plant according to the invention. This one differs from the fragmentation plant shown in FIG. 11*a* merely in that all electrode protrusions 4*a*, 4*b*, 4*c*, 4*d*, 5*a*, 5*b*, 5*c*, 5*d*, 5*e*, 5*f*, 5*g*, 5*h* inclined in a direction that is opposite to the intended passing-through direction S protrude into the passage opening 1. Thereby, the four electrode protrusions 4*a*, 4*b*, 4*c*, 4*d*, which protrude from the central isolator body 6 into the passage opening 1, form the upper end of the high-voltage electrode 9.

Figure 12:
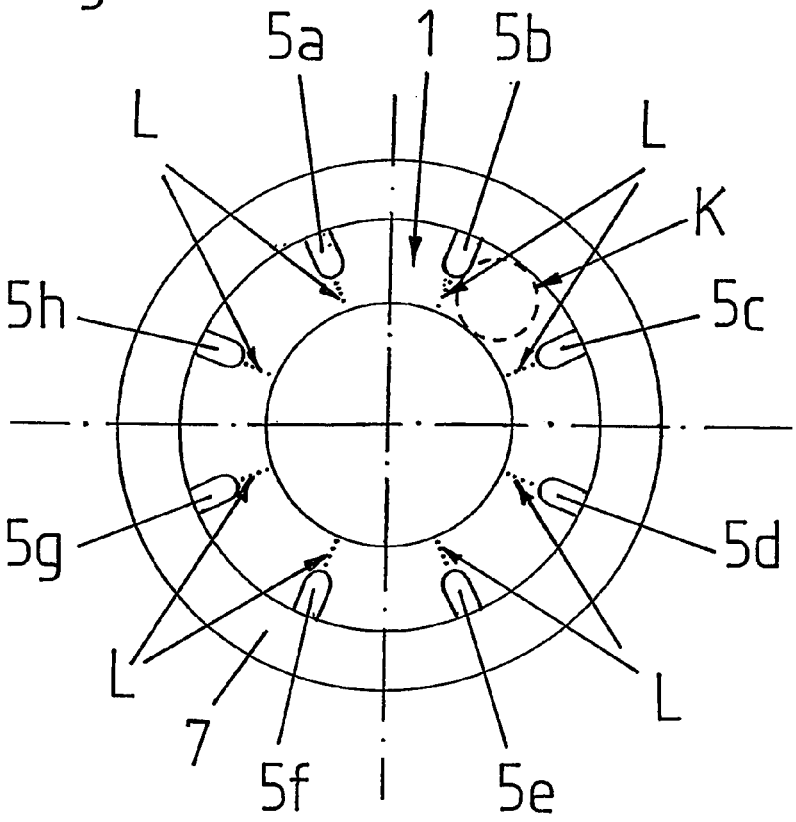
FIG. 12 a topview onto a thirteenth electrode arrangement according to the invention.

FIG. 12 shows a thirteenth electrode arrangement according to the invention in a topview, which differs from the electrode arrangement shown in FIG. 11 merely in that, instead of the central isolator body with the electrode protrusions arranged at it, a cone-shaped electrode 4 made of metal forms the inner boundaries of the passage opening 1. Thereby, the stick-shaped electrode protrusions 5*a*, 5*b*, 5*c*, 5*d*, 5*e*, 5*f*, 5*g*, 5*h* which radially protrude from the inner side of the pipe-shaped isolator body 7 into the passage opening 1 in each case form, with the boundary area of the cone-shaped electrode 4 which is positioned opposite to them, in total eight electrode pairs 4, 5*a*; 4, 5*b*; 4, 5*c*; 4, 5*d*; 4, 5*e*; 4, 5*f*; 4, 5*g*; 4, 5*h*, by means of which in each case high-voltage discharges can be generated within the passage opening 1. The shortest connecting lines L between the electrodes of the respective electrode pairs also here are depicted in dashed lines.

As can be seen, the passage opening 1 here is formed by the pipe-shaped isolator body 7 with the electrode protrusions 5*a*, 5*b*, 5*c*, 5*d*, 5*e*, 5*f*, 5*g*, 5*h* arranged thereon and the central cone-electrode 4 in such a way that for each electrode pair 4, 5*a*; 4, 5*b*; 4, 5*c*; 4, 5*d*; 4, 5*e*; 4, 5*f*; 4, 5*g*; 4, 5*h* in the area of the shortest connecting line L between the electrodes of the respective electrode pair, a ball K can pass through the passage opening 1, the diameter of which is bigger than the length of the shortest connecting line L between the electrodes of the respective electrode pair 4, 5*a*; 4, 5*b*; 4, 5*c*; 4, 5*d*; 4, 5*e*; 4, 5*f*; 4, 5*g*; 4, 5*h*.

Figure 12A:
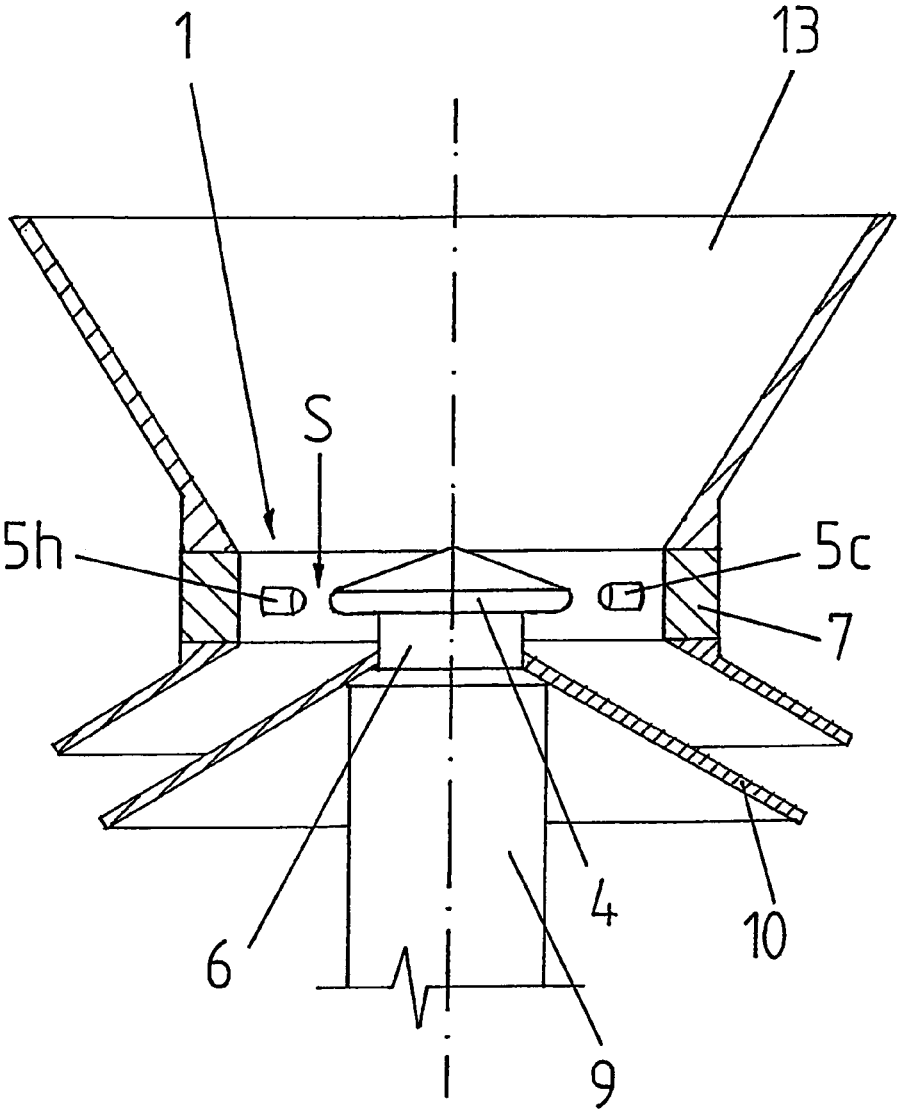
FIG. 12*a* a vertical section through a part of a third fragmentation plant according to the invention comprising the electrode arrangement of FIG. 12.

FIG. 12*a* shows a vertical section through a part of a third fragmentation plant according to the invention comprising the electrode arrangement of FIG. 12. This fragmentation plant differs from the fragmentation plant according to the FIGS. 11*a*-11*d* merely in the design of the central high-voltage electrode 9, the upper end of which here is formed by the cone-shaped electrode 4. All other statements made with regard to the electrode arrangement shown in the FIGS. 11*a*-11*d* analogously apply also to this electrode arrangement and therefore must not be repeated here.

Figure 12B:
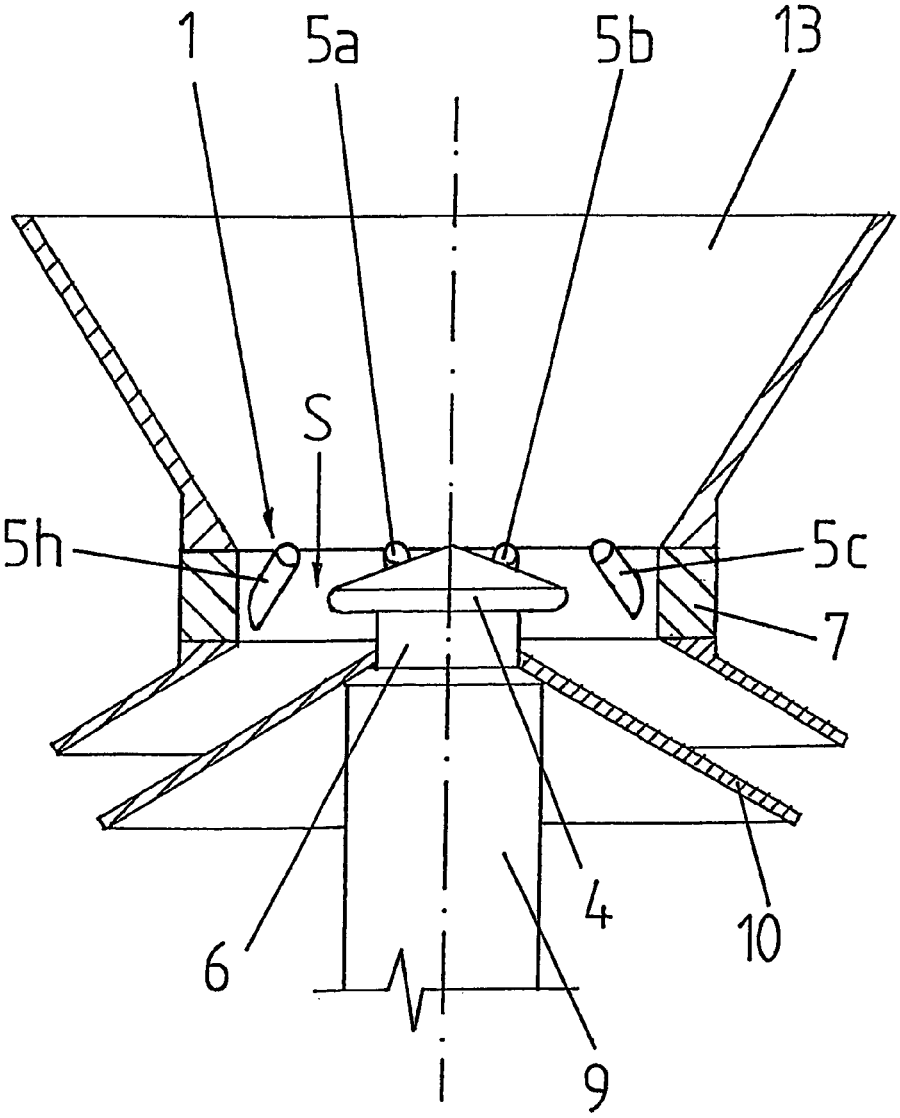
FIG. 12*b* a representation as FIG. 12*a* of the third plant according to the invention with a variant of the electrode arrangement of FIG. 12.

FIG. 12*b* shows a variant of the third fragmentation plant according to the invention. This one differs from the fragmentation plant shown in FIG. 12*a* merely in that the electrodes 5*a*, 5*b*, 5*c*, 5*d*, 5*e*, 5*f*, 5*g*, 5*h* which are arranged at the pipe-shaped isolator body 7 inclined in a direction which is opposite to the intended passing-through direction S protrude into the passage opening 1.

Figure 13:
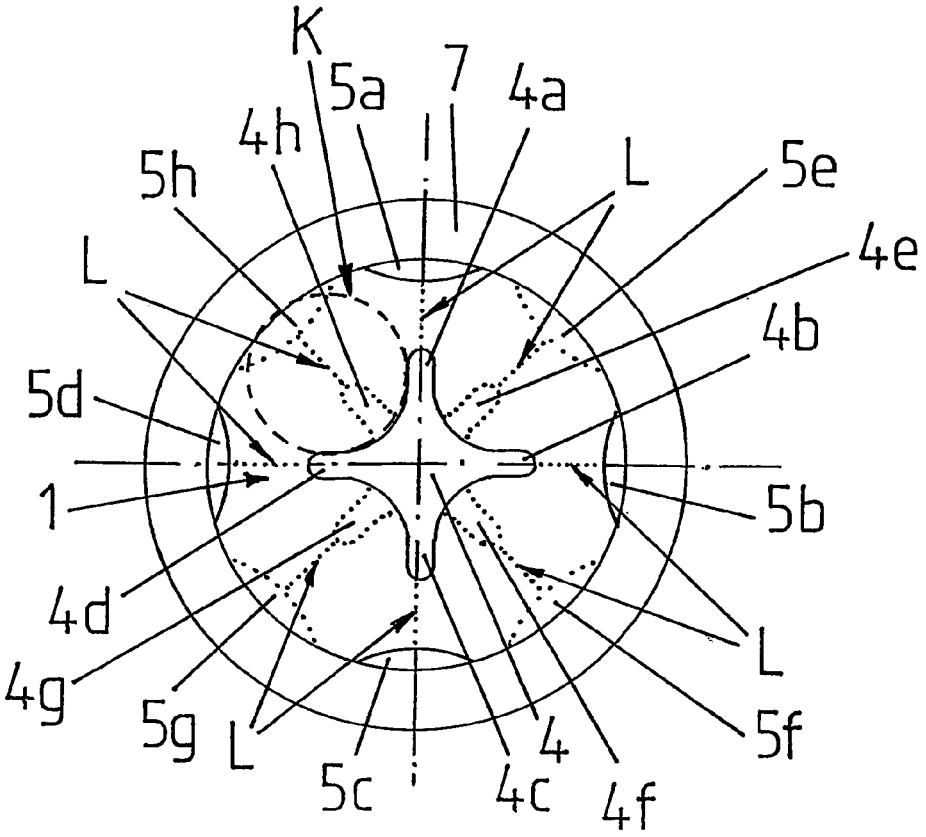
FIG. 13 a topview onto a fourteenth electrode arrangement according to the invention.

FIG. 13 shows a fourteenth electrode arrangement according to the invention in a topview, which differs from the electrode arrangement shown in FIG. 9 merely in that it consists of two electrode arrangements according to FIG. 9, which are arranged one behind the other and which comprise a common isolator body 7, and in that the rear electrode arrangement with respect to the front electrode arrangement is rotated by an angle of 45°. The electrodes 4*e*, 4*f*, 4*g*, 4*h* and 5*e*, 5*f*, 5*g*, 5*h* of the rear electrode arrangement are depicted here in dotted lines in order to indicate that these are arranged in a plane behind the electrodes 4*a*, 4*b*, 4*c*, 4*d* und 5*a*, 5*b*, 5*c*, 5*d* of the front electrode arrangement. All other statements made with regard to the electrode arrangement shown in FIG. 9 analogously apply also to this electrode arrangement and therefore must not be repeated here.

Figure 14:
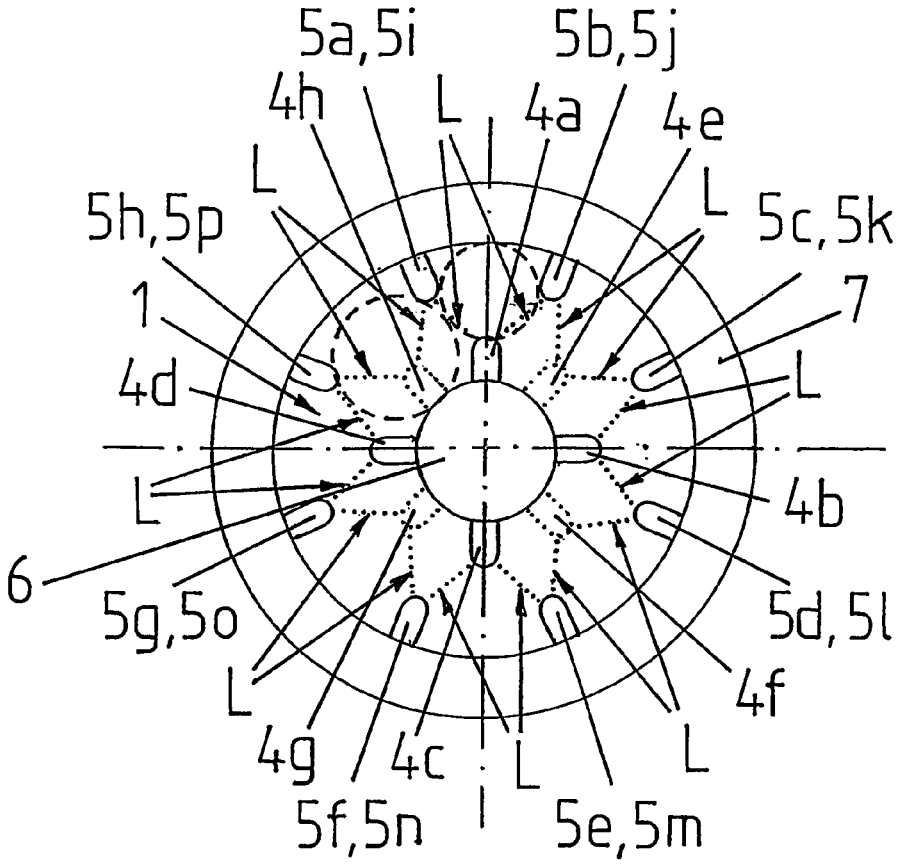
FIG. 14 a topview onto a fifteenth electrode arrangement according to the invention.

FIG. 14 shows a fifteenth electrode arrangement according to the invention in a topview, which differs from the electrode arrangement shown in FIG. 11 merely in that it consists of two electrode arrangements according to FIG. 11 arranged one behind the other, which comprise a common isolator body 7, and in that the electrode protrusions 4*e*, 4*f*, 4*g*, 4*h* of the rear electrode arrangement, which protrude from the central isolator body 6 into the passage channel 2, are rotated around the central axis of the electrode arrangement about an angle of 45°. The electrode protrusions 4*e*, 4*f*, 4*g*, 4*h* of the rear electrode arrangement are again depicted here in dotted lines in order to indicate that these are arranged in a plane behind the electrode protrusions 4*a*, 4*b*, 4*c*, 4*d* und 5*a*, 5*b*, 5*c*, 5*d*, 5*e*, 5*f*, 5*g*, 5*h* of the front electrode arrangement. The electrode protrusions 5*i*, 5*j*, 5*k*, 51, 5*m*, 5*n*, 5*o*, 5*p* of the rear electrode arrangement are not visible here, since in this representation they are hidden behind the electrode protrusions 5*a*, 5*b*, 5*c*, 5*d*, 5*e*, 5*f*, 5*g*, 5*h* of the front electrode arrangement. They are, however, in part visible in FIG. 14*a*. All other statements made with regard to the electrode arrangement shown in FIG. 11 analogously apply also to this electrode arrangement and therefore must not be repeated here.

Figure 14A:
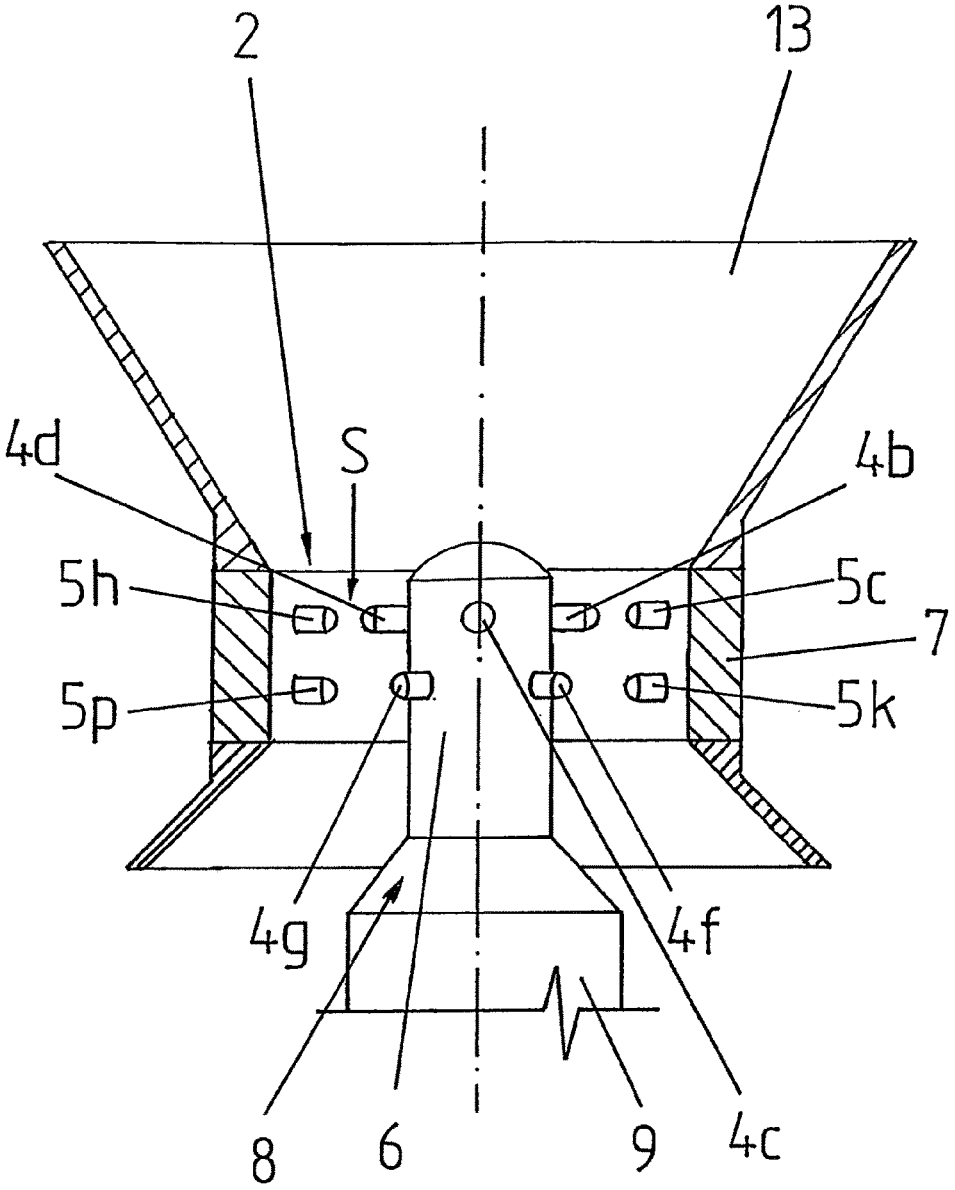
FIG. 14*a* a vertical section through a part of a fourth fragmentation plant according to the invention comprising the electrode arrangement of FIG. 14.

FIG. 14*a* shows a vertical section through a part of a fourth fragmentation plant according to the invention comprising an electrode arrangement according to FIG. 14.

Also in this fragmentation plant, the electrode arrangement is oriented in such a manner that the passage channel 2 has a vertical passing-through direction S. Thereby, the central isolator body 6 with the eight electrode protrusions 4*a*, 4*b*, 4*c*, 4*d*, 4*e*, 4*f*, 4*g*, 4*h*, which in an offset manner are arranged at the circumference, forms the upper end of a cylindrical high-voltage electrode 9, which, as already in the earlier described fragmentation plants, is connected with a high-voltage pulse generator which is arranged directly underneath it, for commonly charging the electrode protrusions 4*a*, 4*b*, 4*c*, 4*d*, 4*e*, 4*f*, 4*g*, 4*h* with high-voltage pulses. The electrode protrusions 5*a*, 5*b*, 5*c*, 5*d*, 5*e*, 5*f*, 5*g*, 5*h*, 5*i*, 5*j*, 5*k*, 51, 5*m*, 5*n*, 5*o*, 5*p* which are carried by the pipe-shaped isolator body 7 are commonly put on ground potential.

As already in the earlier described fragmentation plants, also here, above the electrode arrangement there is arranged a feeding funnel 13, by means of which the fragmentation material that is to be fragmented by gravity forces is fed into the electrode arrangement.

In this fragmentation plant, a truncated-cone-shaped embodiment 8 of the isolator body 6 of the high-voltage electrode 9 underneath the electrode arrangement, i.e. on the discharging side of the electrode arrangement, forms a deflecting device, which radially towards the outside deflects the fragmentation material which is discharged from the electrode arrangement and has been fragmented to target size and guides it away by gravity forces from the electrode arrangement.

Figure 14B:
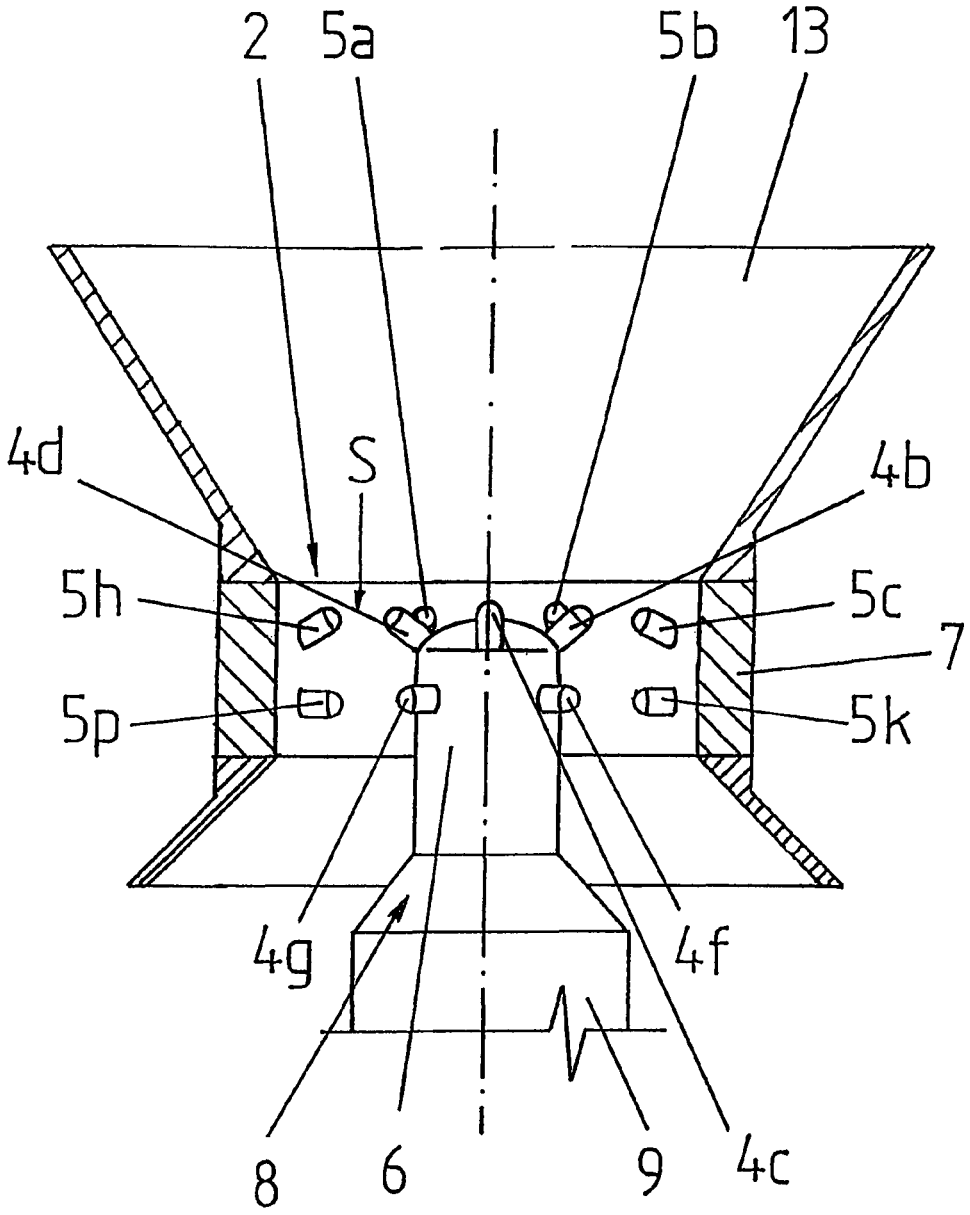
FIG. 14*b* a representation as FIG. 14*a* of the fourth fragmentation plant according to the invention with a variant of the electrode arrangement of FIG. 14.

FIG. 14*b* shows a variant of the fourth fragmentation plant according to the invention. This differs from the fragmentation plant shown in FIG. 14*a* in that all electrode protrusions 4*a*, 4*b*, 4*c*, 4*d*, 5*a*, 5*b*, 5*c*, 5*d*, 5*e*, 5*f*, 5*g*, 5*h*, which seen in passing-through direction S are arranged at the first axial position, inclined in a direction opposite to the intended passing-through direction S protrude into the passage channel 2. Thereby, the four electrode protrusions 4*a*, 4*b*, 4*c*, 4*d*, which from the central isolator body 6 protrude into the passage channel 2, form the upper end of the high-voltage electrode 9. The electrode protrusions 4*e*, 4*f*, 4*g*, 4*h*, 5*i*, 5*j*, 5*k*, 51, 5*m*, 5*n*, 5*o*, 5*p*, which seen in passing-through direction S are arranged at the second axial position, perpendicularly to the intended passing-through direction S protrude into the passage channel 2.

Figure 15:
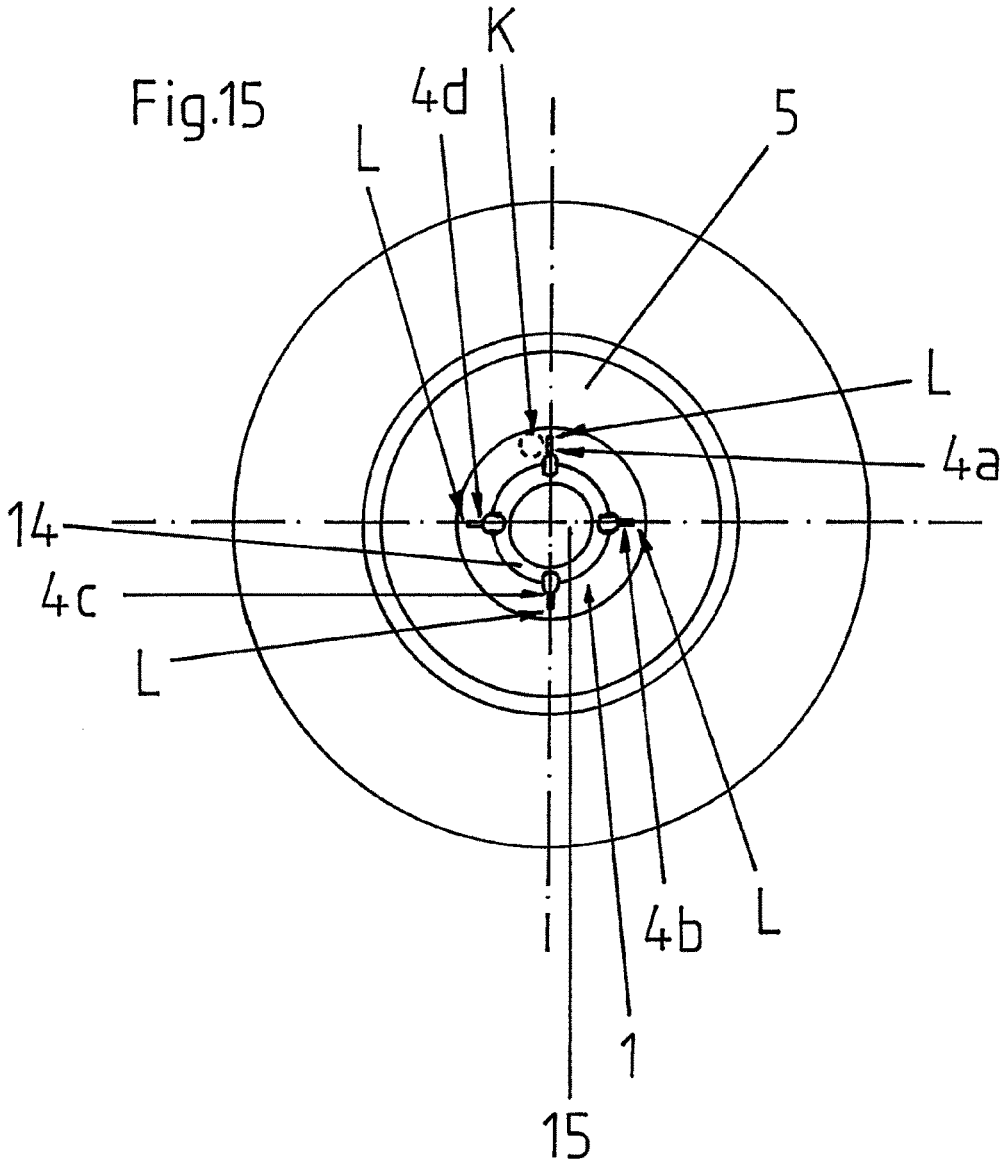
FIG. 15 a topview onto a sixteenth electrode arrangement according to the invention.
Figure 15A:
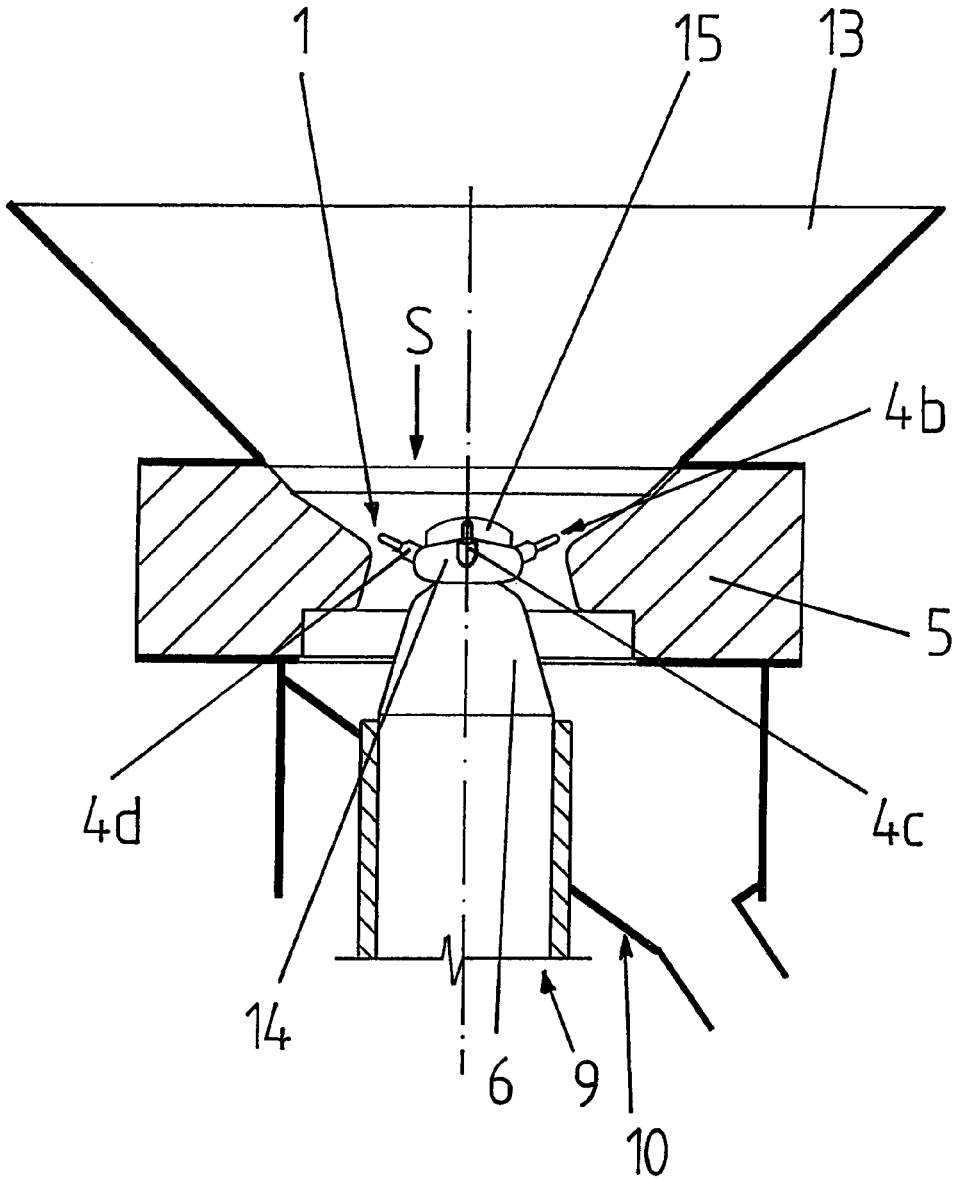
FIG. 15*a* a vertical section through a part of a fifth fragmentation plant according to the invention comprising the electrode arrangement of FIG. 15.

FIG. 15 shows a sixteenth electrode arrangement according to the invention in the topview, and FIG. 15*a* a vertical section through a part of a fifth fragmentation plant according to the invention comprising the electrode arrangement of FIG. 15. These differ from the electrode arrangement shown in FIG. 8 and from the plant shown in FIG. 8*a* substantially in that the electrode protrusions 4*a*, 4*b*, 4*c*, 4*d* here are carried by a electrically conductive lens-shaped body 14, which at its lower side abuts against the isolator body 6 of the high-voltage electrode 9 and at its face side, which is pointing in a direction opposite to the intended passing-through direction S, carries an isolator cap 15. A further difference consists in that a metal ring 5 here forms a feed hopper for the passage opening 1. As in all before described fragmentation plants, also here a feeding funnel 13 is arranged above the electrode arrangement, i.e. on the entry side of the electrode arrangement, by means of which the fragmentation material that is to be fragmented, by gravity forces, can be fed to the electrode arrangement.

Likewise, as in all before described fragmentation plants, also here, underneath the electrode arrangement, i.e. on the discharging side of the electrode arrangement, a deflecting device in the form of a deflecting sheet 10 is arranged, which deflects the fragmentation material which is discharged from the electrode arrangement and has been fragmented to target size towards the outside and removes it by means of gravity forces from the electrode arrangement. In the present case, this deflecting sheet 10, however, is not cone-shaped as in the before described fragmentation plants but is embodied as a substantially flat inclined surface, which is penetrated by the high-voltage electrode.

While in the present application there are described preferred embodiments of the invention, it is to be distinctively understood that the invention is not limited thereto but may be otherwise variously embodied and practiced within the scope of the following claims.

The invention claimed is:

1. An electrode arrangement for an electrodynamic fragmentation plant, the electrode arrangement comprising:

a passage opening or passage channel for fragmentation material;

at least one pair of electrodes, wherein charging the electrodes with high-voltage pulses generates high-voltage discharges within the passage opening or passage channel for fragmentation of fragmentation material;

a connecting line extending through the passage opening or channel and between the pair of electrodes, the connecting line representing a shortest distance between the pair of electrodes in a direction extending transverse to a central axis of the passage opening or channel; and at least one passage for the fragmentation material defined by the passage opening or passage channel the at least one passage extending over an entire length of the passage opening or passage channel and having a diameter that is bigger than a length of the connecting line.

2. The electrode arrangement according to claim 1, wherein the electrode arrangement comprises several pairs of electrodes, wherein charging the electrodes with high-voltage pulses generates high-voltage discharges within the passage opening or passage channels for fragmentation of fragmentation material.

3. The electrode arrangement according to claim 1, wherein the at least one area includes an area on both sides of the connecting line.

4. The electrode arrangement according to claim 1, wherein the diameter is bigger than 1.2 times the length of the connecting line.

5. The electrode arrangement according to claim 1, wherein the passage opening or passage channel has a cross-sectional shape which is round or square, and wherein the at least one pair of electrodes comprises one or more electrode protrusions extending from an outer boundary of the passage opening or passage channel and protruding into the passage opening or passage channel, leaving open a center of the passage opening or passage channel.

6. The electrode arrangement according to claim 1, wherein the passage opening or passage channel has a cross-sectional shape which is ring-shaped.

7. The electrode arrangement according to claim 6, wherein the at least one pair of electrodes comprises one or several electrode protrusions protruding into the passage opening or passage channel from an inner and/or outer boundary of the passage opening or passage channel.

8. The electrode arrangement according to claim 5, wherein the electrode protrusions extend perpendicularly to an intended passing-through direction or inclined in a direction opposite to the intended passing-through direction.

9. The electrode arrangement according to claim 7, wherein the inner boundaries and/or the outer boundaries of the passage opening or of passage channel are formed by an isolator body, which carries individual electrode protrusions.

10. The electrode arrangement according to claim 7, wherein from the inner boundaries and from the outer boundaries of the passage opening or passage channel several electrode protrusions protrude into the passage opening or passage channel, and wherein to each of the electrode protrusions, which protrude from the inner boundaries into the passage opening or passage channel, in each case there are dedicated at least two of the electrode protrusions which are protruding from the outer boundaries into the passage opening or into the passage channel.

11. The electrode arrangement according to claim 7, wherein from the inner boundaries of the passage opening or passage channel one or several electrode protrusions protrude into the passage opening or passage channel, and wherein the outer boundaries of the passage opening or of the passage channel are formed by one single, ring-shaped electrode.

12. The electrode arrangement according to claim 7, wherein from the inner boundaries of the passage opening or passage channel several electrode protrusions protrude into the passage opening or passage channel, a part of which or all of which, inclined in a direction opposite to an intended passing-through direction, protruding into the passage opening or passage channel, such that their free ends in axial direction extend beyond a body which carries these electrode protrusions.

13. The electrode arrangement according to claim 6, wherein the inner boundaries of the passage opening or passage channel are formed by one single, disc-shaped, stick-shaped or ball-shaped electrode.

14. The electrode arrangement according to claim 1, wherein the electrode arrangement comprises a passage channel for fragmentation material, within which at different axial positions with respect to an intended passing-through direction, from outer boundaries and/or from inner boundaries of the passage channel electrode protrusions protrude into the passage channel.

15. The electrode arrangement according to claim 14, wherein the electrode protrusions, which are arranged at different axial positions, at different circumferential positions of the outer boundaries and/or of the inner boundaries protrude into the passage channel.

16. The electrode arrangement according to claim 14, wherein a part of or all of the electrode protrusions, which seen in the passing-through direction are arranged at the first axial position, inclined in a direction opposite to the intended passing-through direction protrude into the passage channel.

17. Electrode arrangement according to claim 16, wherein at least a part of or all of the electrode protrusions, which protrude from the inner boundaries of the passage channel into the passage channel and are arranged at the first axial position, inclined in a direction opposite to the intended passing-through direction protrude into the passage channel.

18. The electrode arrangement according to claim 16, wherein the electrode protrusions, which seen in the passing-through direction are arranged at an axial position following the first axial position, perpendicularly to the passing-through direction or inclined in direction of the passing-through direction protrude into the passage channel.

19. The electrode arrangement according to claim 15, wherein the electrode protrusions protrude into the passage channel in such a manner that the passage channel cannot be passed by a cylindrical body having hemispherical ends, which has a diameter corresponding to the diameter of the largest ball that can pass through the passage channel and has a height of more than 1.1 times this diameter.

20. The electrode arrangement according to claim 5, wherein the electrode protrusions, seen in the passing-through direction, are evenly distributed at the circumference of the outer boundaries and/or of the inner boundaries of the passage opening or of the passage channel.

21. The electrode arrangement according to claim 1, wherein at an intended exit side of the passage opening or passage channel there is arranged a blocking arrangement, which with respect to its geometry, is designed in such a manner and with respect to the passage opening or passage channel is arranged in such a manner that a cylindrical body having hemispherical ends, which body has a diameter corresponding to the diameter of the largest ball that can pass through the passage opening or the passage channel and has a height of more than 1.1 times by the blocking arrangement is prevented from leaving the passage opening or the passage channel, while the largest ball that can pass through the passage opening or the passage channel can be guided away from the passage opening or the passage channel.

22. The electrode arrangement according to claim 21, wherein the blocking arrangement is designed as a deflecting device for the fragmentation material which is discharged.

23. A fragmentation plant comprising an electrode arrangement according to claim 1 and a high-voltage pulse generator for charging the electrodes of the electrode arrangement with high-voltage pulses.

24. The fragmentation plant according to claim 23, wherein the electrode arrangement is aligned in such a manner that the passage opening or passage channel has a vertical passing-through direction.

25. The fragmentation plant according to claim 23, wherein the electrode arrangement has a passage opening or passage channel having a ring-shaped cross-sectional shape and wherein the high-voltage pulse generator is arranged underneath the passage opening or passage channel and the electrodes formed at the inner boundaries of the passage opening or passage channel are directly charged from underneath with high-voltage pulses.

26. The fragmentation plant according to claim 25, wherein the outer boundaries of the passage opening or passage channel or the electrodes arranged at these outer boundaries are on ground potential.

27. Use of the fragmentation plant according to claim 23 for fragmenting of poorly conductive material selected from at least one of the following: silicium, concrete or slag.

28. A method for fragmenting material by means of high-voltage discharges to a fragment size smaller than or equal to a target size, comprising:

a) providing an electrode arrangement according to claim 1 having a passage opening or passage channel which is designed in such a manner that material fragments having a fragment size equal to the target size can pass through the passage opening or passage channel and material fragments having a fragment size bigger than the target size are retained by the electrode arrangement, b) charging the electrode arrangement at one side of the passage opening or the passage channel with material that is to be fragmented having a fragment size bigger than the target size;

c) generating high-voltage discharges within the passage opening or passage channel by charging the electrodes of the electrode arrangement with high-voltage pulses for fragmentation of the material to a fragment size smaller than or equal to the target size; and d) passing the material fragments which have been fragmented to a fragment size smaller than or equal to the target size through the passage opening or the passage channel of the electrode arrangement.

29. The method according to claim 28, wherein the charging of the electrode arrangement with the material that is to be fragmented and the passing of the fragmented material fragments through the passage opening or the passage channel is effected by means of gravitation forces.

30. The method according to claim 28, wherein the passage opening or passage channel of the electrode arrangement during the generating of high-voltage discharges is flooded with a process liquid, wherein the passage opening or passage channel in a passing-through direction of the material is flushed by a stream of process liquid.

31. The electrode arrangement according to claim 1, wherein the passage opening or passage channel is formed by the electrodes.

32. The electrode arrangement according to any one of claim 5, 7, 8, 10, 11, 12, 14, 16, 17 or 18, wherein the electrode protrusions have the shape of a stick or tip.

* * * * *